US012104224B2

(12) United States Patent
Hausner et al.

(10) Patent No.: US 12,104,224 B2
(45) Date of Patent: Oct. 1, 2024

(54) PROCESS FOR TRANSITION METAL OXIDE REDUCTION

(71) Applicant: Helios Project Ltd., Petah Tikva (IL)

(72) Inventors: Jonathan Hausner, Kochav Yair (IL); Jonathan Geifman, Hod Hasharon (IL); Linoam Eliad, Modi'in (IL); Yossi Gofer, Kochav Yair (IL); Baruch Hirsh, Ashkelon (IL); Oran Lori, Petach Tikva (IL)

(73) Assignee: Helios Project Ltd., Petah Tikva (IL)

( * ) Notice: Subject to any disclaimer, the term of this patent is extended or adjusted under 35 U.S.C. 154(b) by 0 days.

(21) Appl. No.: 18/549,540

(22) PCT Filed: Jul. 13, 2022

(86) PCT No.: PCT/IL2022/050754

§ 371 (c)(1),
(2) Date: Sep. 7, 2023

(87) PCT Pub. No.: WO2023/286061

PCT Pub. Date: Jan. 19, 2023

(65) Prior Publication Data

US 2024/0043960 A1 Feb. 8, 2024

Related U.S. Application Data

(60) Provisional application No. 63/221,501, filed on Jul. 14, 2021.

(51) Int. Cl.

| | |
|---|---|
| ***C22B 5/18*** | (2006.01) |
| ***C21B 15/00*** | (2006.01) |
| ***C22B 15/00*** | (2006.01) |
| ***C22B 19/20*** | (2006.01) |
| ***C22B 23/02*** | (2006.01) |
| ***C22B 26/10*** | (2006.01) |
| ***C22B 34/32*** | (2006.01) |
| ***C22B 47/00*** | (2006.01) |

(52) U.S. Cl.

CPC ..... *C22B 5/18* (2013.01); *C21B 15/00* (2013.01); *C22B 15/0052* (2013.01); *C22B 19/20* (2013.01); *C22B 23/02* (2013.01); *C22B 26/10* (2013.01); *C22B 34/32* (2013.01); *C22B 47/0036* (2013.01)

(58) Field of Classification Search

CPC ..... C22B 5/18; C22B 15/00; C22B 15/0052; C22B 19/20; C22B 23/02; C22B 26/10; C22B 34/32; C22B 47/0036

See application file for complete search history.

(56) References Cited

U.S. PATENT DOCUMENTS

| | | | |
|---|---|---|---|
| 3,910,784 | A | 10/1975 | Rastas |
| 8,764,962 | B2 | 7/2014 | Allanore et al. |
| 2020/0263313 | A1 | 8/2020 | Hyers et al. |

FOREIGN PATENT DOCUMENTS

| | | | |
|---|---|---|---|
| DE | 2921786 | A1 | 7/1987 |
| WO | WO 2011092516 | A1 | 8/2011 |

OTHER PUBLICATIONS

PCT International Search Report and Written Opinion, PCT/IL2022/050754, Dec. 7, 2022, 7 Pages.

(Continued)

*Primary Examiner* — Melissa S Swain
(74) *Attorney, Agent, or Firm* — Fenwick & West LLP

(57) ABSTRACT

The present disclosure generally relates to processes for the reduction of transition metals using alkali metals to produce reduced transition metals.

20 Claims, 9 Drawing Sheets

(56) References Cited

OTHER PUBLICATIONS

Addison, C. et al. "Reactions of liquid sodium with transition-metal oxides. Part I. The dioxides of molybdenum, tungsten, and uranium," Journal of the Chemical Society, vol. 829, 1965, pp. 4483-4489.
Addison, C. et al. "Reactions of liquid sodium with transition-metal oxides. Part IV. Oxides of iron, cobalt, nickel, and copper," Journal of the Chemical Society, Dalton Transactions, vol. 10, 1972, pp. 1017-1019.
Cheng, C.F. et al. "Corrosion of nickel in liquid sodium," Corrosion, vol. 28, No. 1, Jan. 1, 1972, pp. 20-22.
Dai, W. et al. "Phase-relationships in the system Fe—Na—O," Metallurgical Transactions B, vol. 15, Jun. 1984, pp. 319-327.
Dai, Y. et al. "Review on sodium corrosion evolution of nuclear-grade 316 stainless steel for sodium-cooled fast reactor applications," Nuclear Engineering and Technology, vol. 53, No. 11, Nov. 1, 2021, pp. 3474-3490.
Garcia-Garcia, A. et al. "Potassium-containing briquetted coal for the reduction of NO," Fuel, vol. 76, No. 6, May 1, 1997, pp. 499-505.
Huang, J. et al. "Thermodynamic study of sodium-iron oxides: Part II. Ternary phase diagram of the Na—Fe—O system," Thermochimica Acta, vol. 405, No. 1, pp. 67-72.
Kobertz, D. et al. "Vaporization studies on sodium oxide," Calphad, vol. 64, Mar. 1, 2019, pp. 327-333.
Kumar, R. et al. "Analysis of sodium generation by sodium oxide decomposition on corrosion resistance materials: a new approach towards sodium redox water-splitting cycle," RSC Advances, vol. 11, No. 34, 2021, pp. 21017-21022.
Malgorzata, R. et al. "Investigation of thermodynamic properties of alkali metals in oxide systems relevant to coal slags," Doctoral Dissertation, Aachen University, 148 pages.
Marques, J. et al. "Exergy analysis for the Na—OH (sodium-oxygen-hydrogen) thermochemical water splitting cycle," International Journal of Hydrogen Energy, vol. 45, No. 20, Apr. 14, 2020, pp. 11424-11437.
Marques, O. et al. "Thermodynamic analysis of a novel trigeneration process of hydrogen, electricity and desalinated water: the case of Na—OH cycle, GEN-IV nuclear reactors and MED installation," Doctoral Thesis, Federal University of Minas Gerais, 2021.
Miyaoka, H. et al. "Low-temperature water-splitting by sodium redox reaction," International Journal of Hydrogen Energy, vol. 37, No. 23, Dec. 1, 2012, pp. 17709-17714.
Ning, J. et al. "A thermodynamic model for the prediction of mild steel corrosion products in an aqueous hydrogen sulfide environment," Corrosion, vol. 71, No. 8, Aug. 1, 2015, pp. 945-960.
O'Hare, P. et al. "Thermochemical and Theoretical Investigations of the Sodium-Oxygen System. I. The Standard Enthalpy of Formation of Sodium Oxide (Na2O)," The Journal of Chemical Physics, vol. 56, No. 9, May 1, 1972, pp. 4513-4516.
Richardson, F.D. et al. "Free energies of formation of metal oxides as a function of temperature," Journal of the Iron and Steel Institute, vol. 160, 1948, pp. 261-273.
Wang, M. et al. "A novel solid oxide electrochemical oxygen pump for oxygen therapy," Journal of the Electrochemical Society, vol. 169, No. 6, Jun. 15, 2022, 10 pages.

PROCESS FOR TRANSITION METAL OXIDE REDUCTION

TECHNICAL FIELD

The present disclosure generally relates to processes for the reduction of transition metals using alkali metals to produce reduced transition metals.

BACKGROUND

Production of metals (such as zinc, iron, nickel, lead, chromium, palladium, copper and silver) is typically performed in large scale either electrochemically or/and by carbothermal reduction. As a result it is usually very pollutive and uses non-reusable catalyst and reagents. Moreover, it is often expensive and energy consuming due to many difficulties in electrochemical reduction processes. Traditional metal production plants are large and require huge capital investments for construction and operation. The commonly used smelting processes and other metals extraction processes, often conducted in several steps, are very energy intensive, producing large amount of carbon dioxide ($CO_2$) and other pollutants.

Commonly used Nickel production methods involve reverberatory furnace followed by electrorefining.

Numerous alternatives had been proposed for the production of high-quality iron (for example), with substantially lower environmental footprints and lower energy demands. Of the most sought studied concepts are electrochemical refineries and electrowinning-based technologies.

US 2020/0263313 discloses systems and methods for molten oxide electrolysis. Metallurgical assemblies and systems according to US 2020/0263313 may include a refractory vessel including sides and a base. The base may define a plurality of apertures centrally located within the base. The sides and the base may at least partially define an interior volume of the refractory vessel. The assemblies may include a lid removably coupled with the refractory vessel and configured to form a seal with the refractory vessel. The lid may define a plurality of apertures through the lid. The assemblies may also include a current collector proximate the base of the refractory vessel. The current collector may include conductive extensions positioned within the plurality of apertures centrally located within the base.

WO 2011/092516 discloses a method for the preparation of iron or iron alloys from iron ore, the method comprising the steps of electrolyzing dissolved iron ore in an electrolytic bath comprising at least one molten salt and optionally including dissolved metals, and separating the resulting iron metal or steel. The at least one molten salt is chosen from salts of alkali metals, alkaline earth metals and transition metals. The method of WO 2011/092516 comprises either an electrowinning process or a liquid/liquid metal extraction process.

U.S. Pat. No. 8,764,962 a method of extracting a target element from an oxide feedstock of the target element, the method comprising: providing a liquid oxide electrolyte comprising at least 75% by weight of one or more oxide compounds, in which the oxide feedstock is dissolved forming ionic oxygen species and ionic target element species; providing an anode comprising a metallic anode substrate wherein one element constitutes at least 50% by weight of the metallic anode substrate, and wherein the one element is more reactive with respect to oxygen than the target element, the metallic anode substrate having a solid oxide layer comprising one or more oxides selected from the group consisting of the target element, the metallic anode substrate and the electrolyte, the anode in contact with the electrolyte; providing a cathode in contact with the electrolyte; driving electrons from the ionic oxygen species in the electrolyte into the metallic substrate across the solid oxide layer thereon so as to form gaseous oxygen; and reducing the ionic target element species in the electrolyte to form a liquid of the target element at the cathode, the target element having a melting temperature greater than 1200° C.

A number of medium scale electrolysis-based plants/reactors had been constructed. However, none have demonstrated possessing an added value over traditional smelters, with problems of construction materials, electrodes and electronic conductivity of the melt. Specifically, electrolysis-based reductions so far were not successful, and cannot meet the EU demand to decarbonize steel production by 2030.

Similarly, hydrogen-based reductive processes for steel and other related metal and alloy still need to overcome major technological barriers in order to meet such decarbonization demand.

There exists a long-felt need for an environmentally conscious process for metal production, which avoid electrolysis and hydrogen reduction and is energy- and cost efficient.

SUMMARY

The following embodiments and aspects thereof are described and illustrated in conjunction with compositions and methods which are meant to be exemplary and illustrative, not limiting in scope. In various embodiments, one or more of the above-described problems have been reduced or eliminated, while other embodiments are directed to other advantages or improvements.

The present invention provides processes for the production of transition metals and alloys thereof from the corresponding transition metal oxides. The present processes are simple and cost effective compared to corresponding processes for preparing transition metals (e.g., electrolysis), and results in typically high purity metals.

In is to be understood that throughout the present disclosure the term "metal" refers the zero oxidation state of the metallic element, unless specified as a metal oxide or a constituent in metal oxides (i.e., a metal cation).

The present invention employs a two-reaction sequence, of individual reactions, which were surprisingly found to be compatible for a reaction sequence (e.g., within a shared reaction or reaction system) and produce a synergistic effect that results in a simple process, and high yield and purity, according to some embodiments. The first reaction (Reaction I) is a reduction of a reduction of a transition metal oxide using an alkali metal, optionally, wherein the reaction is neat (i.e., the reaction mixture consists essentially of the transition metal oxide using and the alkali metal).

Specifically, alkali metals are known to have lower (more negative) redox potentials than transition metal, which promotes a redox reaction of Scheme I:

$$M^T{}_nO_m + 2m \times M^A \rightarrow m \times M^A{}_2O + n \times M^T; \qquad \text{I:}$$

wherein $M^T$ is the transition metal atom; n and m are integers (e.g., 1 to 7), and $M^A$ is the alkali metal.

Thus, the first reaction results in the desired product transition metal and an alkali metal oxide, according to some embodiments. Advantageously, conducting the reaction at a temperature T, which is above the melting point of the alkali metal results in a reaction mixture, wherein the alkali metal is in a fluid state, such that it is highly reactive towards the transition metal oxide. Also, it is advantages that the melting point of alkali metals is relatively low (Na 97.8° C.; K 63.5° C.) and the redox reaction of Scheme I is exothermic, which promotes the two-reaction sequence with minimal investment of external energy.

Lastly, while alkali metals as sodium and potassium are not naturally occurring, their preparation through electrolysis is convenient and they typically do not suffer from the hurdles of direct electrolytic reduction of transition metal oxides, which are provided as ores and are difficult to electrolyze in solution. Moreover, sodium and potassium metals are electrochemically produced from their salts NaCl and KCl respectively), which are abundant in nature. These metals are typically considered to be an industrial by-product of the chlorine gas industry. Therefore, their employment does not consume net energy, rather, it avoids disposal efforts and associated environment damage.

The second reaction (Reaction II) is the thermal decomposition of the alkali metal oxide formed in the previous reaction described above. Specifically, this is portrayed in Scheme II:

$$M^A{}_2O \rightarrow 2\times M^A + 0.5O_2. \qquad \text{II:}$$

Favorably, the decomposition temperature of alkali metal oxides is not very high (Na about 540° C.; K about 300° C.), which, in conjugation with the low melting temperature thereof exothermicity of Reaction I, results in a significant synergistic effect, that highly contributes to the present process over known processes for transition metal production.

Yet another advantage of the present process stems for the net reaction resulting from the combination of the two-reaction sequence. Specifically, the net reaction scheme of Reaction I and Reaction II is shown below as reaction Scheme III (upon balancing the equation through multiplying Scheme II by m):

$$M^T{}_nO_m \rightarrow n\times M^T + 0.5m\times O_2; \qquad \text{III:}$$

As can be immediately appreciated by the person having ordinary skill in the art, the net reaction scheme III does not involve the alkali metal as a consumed reactant, but rather employed as a catalyst. This is highly advantageous. First, recycling of materials in chemical and commercial large-scale synthesis is very important nowadays, as it is recognized that avoiding material consumption leads to environment preservation. Second, since the alkali metal does not net react, the only by-product of the reaction is oxygen, which is a non-harmful gas and is also easy to separate from the produced transition metal.

Yet another advantage of the present process relates to the relative inertness of alkali metals to transition metals, whereby alkali metals·transition metals alloys do not form, even at elevated temperature. Combined with the relatively low boiling temperatures of alkali metals (Na 882.8° C.; K 758.8° C., and lower under reduced pressure) and the high boiling points of first row transition metals (e.g., Fe 2,862° C.; Ni 2,730° C.; Cu 2,562° C.), the product transition metals are easy to isolate through evaporating the oxygen and alkali metal, upon completion of the reaction.

Lastly, the present process has a distinctive advantage over the known transition metal preparation, as it enables easy access to the formation of transition metal alloys. Specifically, there are many highly desired transition metal-containing alloys (e.g., brass, constantan, nitinol etc.), which require high temperatures or other extreme conditions to prepare. The present process provides a distinct route to their formation. In particular, as detailed above, the reaction of Scheme I is exothermic, which, together with the heating of the reaction mixture results in high temperatures, according to some embodiments. Therefore, wherein a process as detailed herein is carried out in the present of a second metal oxide, both metals can be reduced (Scheme I) at a high temperature, which also can induce an alloy-forming reaction between the two metals, according to some embodiments.

Thus, according to some embodiments, there is provided a process for the reduction of a transition metal oxide, the process comprising:

(a) providing at least one transition metal oxide having the formula $M^T{}_nO_m$, wherein each one of n and m is 1, 2, 3, 4, 5, 6 or 7, wherein $M^T$ is a first-row transition metal selected from: Sc, Ti, V, Cr, Mn, Fe, Co, Ni, Cu and Zn;

(b) contacting the transition metal oxide with an alkali metal ($M^A$) in a reactor, and adjusting the temperature within the reactor to a temperature T, to induce a two-reaction sequence of the reaction schemes I and II:

$$M^T{}_nO_m + 2m\times M^A \rightarrow m\times M^A{}_2O + n\times M^T; \qquad \text{I:}$$

$$M^A{}_2O \rightarrow 2\times M^A + 0.5O_2; \qquad \text{II:}$$

so that a net reaction, III, resulting from said two-reaction sequence does not consume the alkali metal, $$M^T{}_nO_m \rightarrow n\times M^T + 0.5m\times O_2; \qquad \text{III:}$$

and a resulting reaction mixture comprises a reduced transition metal, $M^T$, or alloy thereof, the alkali metal, and optionally oxygen;

wherein $M^A$ is Na or K; and wherein temperature T is above the melting point of the alkali metal and equal or above the decomposition temperature of $M^A{}_2O$; and (c) isolating the reduced transition metal or alloy thereof, from the reaction mixture.

According to some embodiments, there is provided a process for the reduction of a transition metal oxide, the process comprising:

(a) providing at least one transition metal oxide having the formula $M^T{}_nO_m$, wherein each one of n and m is 1, 2, 3, 4, 5, 6 or 7, wherein $M^T$ is a first-row transition metal selected from: Sc, Ti, V, Cr, Mn, Fe, Co, Ni, Cu and Zn;

(b) contacting the transition metal oxide with an alkali metal ($M^A$) in a reactor, and adjusting the temperature within the reactor to a temperature T, to provide a resulting reaction mixture comprising a reduced transition metal, $M^T$, or alloy thereof, the alkali metal, and optionally oxygen;

wherein $M^A$ is Na or K; and wherein temperature T is above the melting point of the alkali metal and equal or above the decomposition temperature of $M^A{}_2O$; and (c) isolating the reduced transition metal or alloy thereof, from the reaction mixture.

According to some embodiments, there is provided a process for the reduction of a transition metal oxide, the process comprising:

(a) contacting a transition metal ($M^T$) oxide and an alkali metal ($M^A$) in a reactor;

(b) heating the transition metal oxide and the alkali metal in the reactor to a temperature (T) to produce a reaction mixture comprising a reduced transition metal ($M^T$) and the alkali metal ($M^A$), wherein the temperature (T) is above the melting point of the alkali metal ($M^A$) and equal to or above the decomposition temperature of an oxide of the alkali metal ($M^A{}_2O$); and (c) isolating the reduced transition metal ($M^T$) from the reaction mixture.

According to some embodiments, step (a) comprises continuously providing the at least one transition metal oxide into the reactor, so that the total transition metal oxide provided in step (a) is in molar excess over the alkali metal of step (b), wherein the molar excess is at least 400%.

According to some embodiments, temperature T is equal or above the boiling point of the alkali metal.

According to some embodiments, the isolation of step (c) entails evaporating the alkali metal from the reactor; and the process further comprises step (d) of collecting the isolated transition metal or alloy thereof.

According to some embodiments, temperature T is equal or above the boiling point of the alkali metal, wherein the isolation of step (c) entails evaporating the alkali metal from the reactor; and the process further comprises step (d) of collecting the isolated transition metal or alloy thereof.

According to some embodiments, the process further comprises step (e) of condensing the evaporated alkali metal; and step (f) of transferring the condensed alkali metal into the reactor, thereby recycling the alkali metal.

According to some embodiments, the process comprises:

(a) providing the at least one transition metal oxide (b) combining the transition metal oxide with an alkali metal at a temperature T, to induce the two-reaction sequence;

(c) evaporating the alkali metal from the reactor to produce an isolated transition metal or alloy thereof;

(d) collecting the isolated transition metal or alloy thereof;

(e) condensing the evaporated alkali metal; and (f) transferring the condensed alkali metal into the reactor;

wherein step (e) may precede step (d) and wherein the process further comprises repeating step (a)-(d) for at least one additional sequence.

According to some embodiments, $M^T$ is a first-row transition metal selected from the group consisting of: Fe, Ni, Cr, Cu, Zn and Mn. Each possibility represents a separate embodiment of the invention.

According to some embodiments, $M^T$ is Fe;

$M^T{}_nO_m$ is $Fe_2O_3$, FeO, $Fe_3O_4$ or a combination thereof; and reaction schemes I and III are:

$$Fe_2O_3+6\times M^A \rightarrow 3\times M^A{}_2O+2\times Fe; \quad \text{I:}$$

$$Fe_2O_3 \rightarrow 2\times Fe+1.5\times O_2; \quad \text{III:}$$

or $$FeO+2\times M^A \rightarrow M^A{}_2O+Fe; \quad \text{I:}$$

$$FeO \rightarrow Fe+0.5\times O_2; \quad \text{III:}$$

or $$Fe_3O_4+8\times M^A \rightarrow 4\times M^A{}_2O+3\times Fe; \quad \text{I:}$$

$$Fe_3O_4 \rightarrow 3\times Fe+2\times O_2. \quad \text{III:}$$

Each possibility represents a separate embodiment of the invention.

According to some embodiments, $M^T$ is Ni;

$M^T{}_nO_m$ is NiO; and reaction schemes I and III are:

$$NiO+2\times M^A \rightarrow M^A{}_2O+Ni; \quad \text{I:}$$

$$NiO \rightarrow Ni+0.5\times O_2. \quad \text{III:}$$

According to some embodiments, $M^T$ is Cr;

$M^T{}_nO_m$ is $Cr_2O_3$, CrO, $CrO_3$ or a combination thereof; and reaction schemes I and III are:

$$Cr_2O_3+6\times M^A \rightarrow 3\times M^A{}_2O+2\times Cr; \quad \text{I:}$$

$$Cr_2O_3 \rightarrow 2\times Cr+1.5\times O_2; \quad \text{III:}$$

or $$CrO+2\times M^A \rightarrow M^A{}_2O+Cr; \quad \text{I:}$$

$$CrO \rightarrow Cr+0.5\times O_2, \quad \text{III:}$$

or $$CrO_3+6\times M^A \rightarrow 3\times M^A{}_2O+Cr; \quad \text{I:}$$

$$CrO_3 \rightarrow Cr+1.5\times O_2. \quad \text{III:}$$

Each possibility represents a separate embodiment of the invention.

The According to some embodiments, $M^T$ is Cu;

$M^T{}_nO_m$ is $Cu_2O$, CuO, $CuO_2$, or a combination thereof; and reaction schemes I and III are:

$$Cu_2O+2\times M^A \rightarrow M^A{}_2O+2Cu; \quad \text{I:}$$

$$Cu_2O \rightarrow 2\times Cu+0.5\times O_2; \quad \text{III:}$$

or $$CuO+2\times M^A \rightarrow M^A{}_2O+Cu; \quad \text{I:}$$

$$CuO \rightarrow 2\times Cu+0.5\times O_2; \quad \text{III:}$$

or $$CuO_2+4\times M^A \rightarrow 2M^A{}_2O+Cu; \quad \text{I:}$$

$$CuO_2 \rightarrow Cu+O_2. \quad \text{III:}$$

Each possibility represents a separate embodiment of the invention.

According to some embodiments, $M^T$ is Zn;

$M^T{}_nO_m$ZnO; and reaction schemes I and III are:

$$ZnO+2\times M^A \rightarrow M^A{}_2O+Zn; \quad \text{I:}$$

$$ZnO \rightarrow Zn+0.5\times O_2. \quad \text{III:}$$

According to some embodiments, $M^T$ is Mn;

$M^T{}_nO_m$ is MnO, $Mn_3O_4$, $Mn_2O_3$, $MnO_2$, $Mn_2O_7$ or a combination thereof; and reaction schemes I and III are:

$$MnO+2\times M^A \rightarrow M^A{}_2O+Mn; \quad \text{I:}$$

$$MnO \rightarrow Mn+0.5\times O_2; \quad \text{III:}$$

or $$Mn_3O_4+8\times M^A \rightarrow 4\times M^A{}_2O+3\times Mn; \quad \text{I:}$$

$$Mn_3O_4 \rightarrow 3\times Mn+2\times O_2; \quad \text{III:}$$

or $$Mn_2O_3+6\times M^A \rightarrow 3\times M^A{}_2O+2\times Mn; \quad \text{I:}$$

$$Mn_2O_3 \rightarrow 2\times Mn+1.5\times O_2; \quad \text{III:}$$

or $$MnO_2+4\times M^A \rightarrow 2M^A{}_2O+Mn; \quad \text{I:}$$

$$MnO_2 \rightarrow Mn+O_2; \quad \text{III:}$$

or $$Mn_2O_7+14\times M^A \rightarrow 7\times M^A{}_2O+2\times Mn; \quad \text{I:}$$

$$Mn_2O_7 \rightarrow 2\times Mn+3.5\times O_2. \quad \text{III:}$$

Each possibility represents a separate embodiment of the invention.

According to some embodiments, the process is for the preparation of a metal alloy, wherein step (a) comprises providing at least two transition metal oxides having the formulas $M^{Ta}{}_nO_m$, and $M^{Tb}{}_iO_j$, wherein each one of i and j is 1, 2, 3, 4, 5, 6 or 7, wherein each one of $M^{Ta}$, $M^{Tb}$ is a transition metal selected from the group consisting of: Sc, Ti, V, Cr, Mn, Fe, Co, Ni, Cu and Zn; and step (b) comprises combining the transition metal oxides with the alkali metal, wherein reaction schemes I and III are:

$$M^{Ta}{}_nO_m+2m\times M^A \rightarrow m\times M^A{}_2O+n\times M^{Ta}; \quad \text{Ia:}$$

$$M^{Tb}{}_iO_j+2j\times M^A \rightarrow j\times M^A{}_2O+i\times M^{Tb}; \quad \text{Ib:}$$

$$M^{Ta}{}_nO_m \rightarrow n\times M^{Ta}+0.5m\times O_2; \quad \text{IIIa:}$$

$$M^{Tb}{}_iO_j \rightarrow i\times M^{Tb}+0.5j\times O_2; \quad \text{IIIb:}$$

and wherein step (b) further induced reaction IV of forming the alloy:

$$M^{Ta}+M^{Tb} \rightarrow M^{Ta}\cdot M^{Tb}. \quad \text{IV:}$$

According to some embodiments, the alkali metal is Na and scheme II is:

$$Na_2O \rightarrow 2Na+0.5O_2. \quad \text{II:}$$

According to some embodiments, T is at least 540° C.

According to some embodiments, the alkali metal is K and scheme II is:

$$K_2O \rightarrow 2K+0.5O_2. \quad \text{II:}$$

According to some embodiments, T is at least 300° C.

According to some embodiments, step (c) comprises evaporating the alkali metal and oxygen from the reactor to produce an isolated transition metal or alloy thereof at a purity of at least 90% w/w.

According to some embodiments, the transition metal is Fe, Co, Ni or Cu, and the purity is of at least 99% w/w.

According to some embodiments, the reaction mixture of step (b) is substantially devoid of additional solvents and carriers, and is consisting essentially of the transition metal oxide, the alkali metal and the product reduced transition metal or alloy thereof.

According to some embodiments, the two-reaction sequence of step (b) is conducted in an air and water protected environment.

According to some embodiments, the process further comprises providing a system comprising:

a reactor, which comprises:

a housing defining a reaction chamber, and a transition metal oxide inlet, an alkali metal inlet, an alkali metal outlet and an isolated transition metal or alloy outlet, where each of said inlets and outlets is in fluid communication with the reaction chamber;

an alkali metal container comprising an alkali metal inlet and an alkali metal outlet;

an isolated transition metal or alloy container comprising a transition metal inlet;

a condenser, configured to condense the evaporated alkali metal, the condenser comprising a proximal end connected to the alkali metal outlet of the reactor, and a distal end connected to the alkali metal inlet of the alkali metal container;

an alkali metal transfer pipe comprising a proximal end connected to the alkali metal inlet of the reactor, and a distal end connected to the alkali metal outlet of the alkali metal container;

a transition metal transfer pipe comprising a proximal end connected to the transition metal outlet of the reactor, a distal end connected to the transition metal inlet of the isolated transition metal or alloy container.

According to some embodiments, the reactor further comprises an inert gas inlet and a gas outlet, where each is in fluid communication with the reaction chamber, and the inert gas inlet is in fluid communication with an inert gas source.

According to some embodiments, the present process comprises:

(a) providing the at least one transition metal oxide into the reaction chamber through the transition metal oxide inlet;

(b) combining the transition metal oxide with an alkali metal within the reaction chamber, to induce the two-reaction sequence;

(c) evaporating the alkali metal through the alkali metal outlet of the reactor to produce an isolated transition metal or alloy thereof;

(d) transferring the isolated transition metal or alloy thereof into the isolated transition metal or alloy container through the transition metal transfer pipe;

(e) condensing the evaporated alkali metal using the condenser into the alkali metal container; and (f) transferring the condensed alkali metal from the alkali metal container into the reactor through the alkali metal transfer pipe;

wherein step (e) may precede step (d).

According to some embodiments, step (b) further comprises inserting inert gas into the reaction chamber through the inert gas inlet, thereby maintaining a reaction environment protected from air.

According to some embodiments, step (b), step (c) or both further comprises evacuating the formed oxygen gas through the gas outlet of the reactor.

According to some embodiments, the condenser further comprises a unidirectional valve, positioned between its proximal and distal end, wherein the valve is configured to regulate the flow of evaporated alkali metal from the rector to the alkali metal container;

the alkali metal transfer pipe further comprises a unidirectional valve, positioned between its proximal and distal end, wherein the valve is configured to regulate the flow of condensed alkali metal from the alkali metal container to the rector;

the transition metal transfer pipe further comprises a unidirectional valve, positioned between its proximal and distal end, wherein the valve is configured to regulate the flow of isolated transition metal or metal alloy from the rector to the isolated transition metal or alloy container.

Further embodiments and the full scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In addition to the exemplary aspects and embodiments described above, further aspects and embodiments will become apparent by reference to the figures and by study of the following detailed descriptions.

BRIEF DESCRIPTION OF THE FIGURES

The accompanying figures, which are included to provide a further understanding of the invention and are incorporated in and constitute a part of this specification, illustrate embodiments of the invention and together with the description serve to explain the principles of the invention wherein.

DETAILED DESCRIPTION

Figure 1:
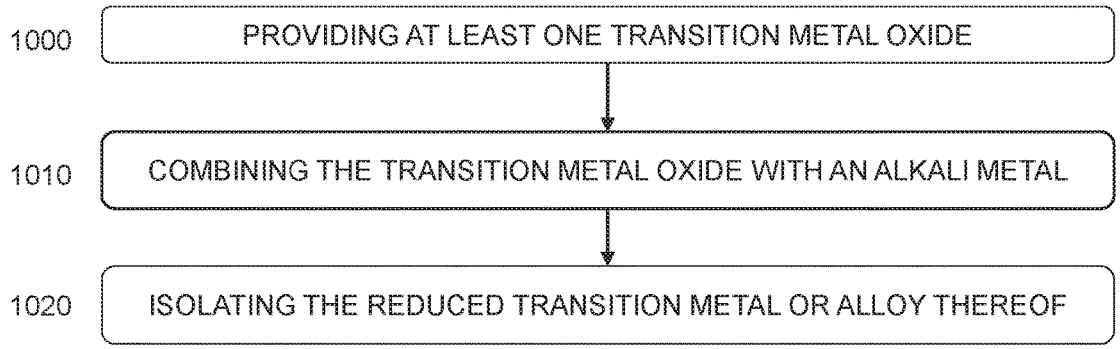
FIG. 1 is a block diagram representing a process for the reduction of at least one transition metal oxide into the corresponding transition metal or alloy thereof, according to some embodiments.

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

According to some embodiments, there is provided a process for the reduction of one or more transition metal oxides into the corresponding transition metals or alloys containing the same. The present process is based on the two-reaction sequence of:

$$M^T{}_nO_m + 2m \times M^A \rightarrow m \times M^A{}_2O + n \times M^T; \quad \text{I:}$$

$$M^A{}_2O \rightarrow 2 \times M^A + 0.5O_2; \quad \text{II:}$$

wherein $M^T$, $M^A$, n, and m are as described herein, and which results in the net reaction Scheme III:

$$M^T{}_nO_m \rightarrow n \times M^T + 0.5m \times O_2; \quad \text{III:}$$

Several advantages of the present process over the art are elaborated herein. In short:

(i) The reactions I and II were found to be compatible one with the other so that they can be performed sequentially (e.g., within one reaction system), which is proved to be a simple procedure, according to some embodiments.

(ii) The reactions I and II were found to have a synergistic effect that results in high yield, according to some embodiments.

(iii) The above synergism further results in high purity metals and alloys, according to some embodiments.

(iv) The reaction can be done neat (i.e., without solvents), which is environmentally beneficial, according to some embodiments.

(v) Conducting the reaction at a temperature above the melting point of the alkali metal results in a reaction mixture, wherein the alkali metal is in a reactive fluid state, according to some embodiments.

(vi) Employment of alkali metals is advantageous since their melting point is relatively low, so that only moderate energy, or no net energy needs to be invested, according to some embodiments. For example, sodium and potassium metals are considered by products, which can be used instead of disposed of, which is an economic and environmental advantage.

(vii) The redox reaction I is exothermic, which promotes the two-reaction sequence with minimal investment of external energy—another economic and environmental advantage, according to some embodiments.

(viii) The electro-synthesis of alkali metals, which are the catalysts of the reaction is convenient, according to some embodiments.

(ix) The decomposition temperature of alkali metal oxides is not very high, which further promotes the two-reaction sequence with minimal investment of external energy—yet another economic and environmental advantage, according to some embodiments.

(x) the net reaction III, which portrays the combination of reactions I and II does not consume the alkali metal(s), i.e, they are used as catalysts. Since they are used as catalyst, they are inherently recycled, so that only a small amount of the alkali metals is required to produce large amounts of transition metals or alloys through the present process, which is also both an economic and environmental advantage.

(xi) The only by-product of the reaction-sequence of the present invention is oxygen, which is a non-harmful gas and is also easy to separate from the produced transition metal, according to some embodiments.

(xii) Alkali metals do not easily react with transition metals (i.e., whereby alkali metal·transition metal alloys do not form at the conditions of the present process leaving the post-reactions mixture substantially clean of by product contaminants, according to some embodiments.

(xiii) Alkali metals have low boiling temperatures, whereas first row transition metals have high boiling points which makes it easy to isolate the product transition metals or alloys through evaporating the oxygen and alkali metal after completion of the reaction, according to some embodiments.

(xiv) When the process is conducted in the presence of a second metal or metal oxide, the he combined exothermicity of Reaction I and the heating of the reaction mixture, may lead to formation of an alloy from the first metal (i.e., the transition metal, which was initially provided as an oxide) and the second metal, according to some embodiments.

According to some embodiments, there is provides a process for the reduction of a transition metal oxide, the process comprising performing steps (a) to (c), and optionally, additional steps, as elaborated herein.

Specific reference is now made to step (a) of the present process, which comprises providing at least one transition metal oxide, according to some embodiments.

According to some embodiments, step (a) comprises providing at least one transition metal oxide having the formula $M^T{}_nO_m$. According to some embodiments, step (a) comprises providing a transition metal oxide having the formula $M^T{}_nO_m$. According to some embodiments, step (a) comprises providing a single transition metal oxide having the formula $M^T{}_nO_m$.

Specifically, as can be understood by the person having ordinary skill in the art, provision of more than one transition metal oxide of formula $M^T{}_nO_m$ in step (a) can lead, according to some embodiments, to formation of a transition metal alloy upon completion of the present process, as elaborated herein. Alternatively, according to some embodiments, provision of one transition metal oxide of formula $M^T{}_nO_m$ in step (a) can lead to the formation of a reduced transition metal upon completion of the present process. Particularly, if the reaction mixture of step (b) contains no metals or metal oxides, which are alloyable with the transition metal provided in step (a), the result of the two-reaction sequence of step (b) will be a transition metal, according to some embodiments. However, if another metal, which is alloyable with the transition metal provided in step (a), or an oxide of such alloyable metal is present in the reaction mixture of step (b), an alloy may form from the two metals.

According to some embodiments, n is 1, 2, 3, 4, 5, 6 or 7. Each possibility represents a separate embodiment of the invention. According to some embodiments, n is 1, 2 or 3.

According to some embodiments, m is 1, 2, 3, 4, 5, 6 or 7. Each possibility represents a separate embodiment of the invention.

According to some embodiments, $M^T$ is a metal. According to some embodiments, $M^T$ is a transition metal. According to some embodiments, $M^T$ is a first-row transition metal.

Generally, the term "first row transition metal element" refers to any one of the elements 21-29, namely, scandium (Sc), titanium (Ti), vanadium (V), chromium (Cr), manganese (Mn), iron (Fe), cobalt (Co), nickel (Ni), and copper (Cu).

According to some embodiments, $M^T$ is elected from the group consisting of: Sc, Ti, V, Cr, Mn, Fe, Co, Ni, Cu and Zn. Each possibility represents a separate embodiment of the invention. According to some embodiments, the transition metal is Sc. According to some embodiments, the transition metal is Ti. According to some embodiments, the transition metal is V. According to some embodiments, the transition metal is Cr. According to some embodiments, the transition metal is Mn. According to some embodiments, the transition metal is Fe. According to some embodiments, the transition metal is Co. According to some embodiments, the transition metal is Ni. According to some embodiments, the transition metal is Cu. According to some embodiments, the transition metal is Zn.

According to some embodiments, the transition metal oxide is provided in step (a) as a solid.

As detailed herein, during step (b) the transition metal oxide is consumed to provide a transition metal and oxygen, whereas the alkali metal is preserved and recycled, according to some embodiments. This enables to continuously provide additional transition metal oxide into the reaction mixture and to continuously obtain additional transition metal.

According to some embodiments, step (a) comprises continuously providing the at least one transition metal oxide into the reactor, so that the total transition metal oxide provided in step (a) is in molar excess over the alkali metal of step (b). According to some embodiments, step (a) comprises gradually providing the at least one transition metal oxide into the reactor. It is to be understood that at any time during step (b) the alkali metal may within the reactor be in molar excess over the transition metal oxide therein, according to some embodiments, however, according to the present embodiment, the transition metal oxide is continuously added and consumed so that the total transition metal oxide provided over the time is in molar excess over the alkali metal catalyst.

For purposes of this specification, the term "continuously" means that the transition metal oxide is added to the reactor over time. The term is not limited to uninterrupted or interrupted (e.g., batch) addition of the transition metal oxide.

According to some embodiments, the molar excess is at least 50% mol/mol, at least 100% mol/mol, at least 200% mol/mol, at least 300% mol/mol, at least 400% mol/mol, at least 500% mol/mol, at least 750% mol/mol, at least 1,000% mol/mol, at least 2,000% mol/mol, at least 5,000% mol/mol or at least 10,000% mol/mol. Each possibility represents a separate embodiment of the invention. According to some embodiments, the molar excess is in the range of 100% to 1,000,000% mol/mol, 500% to 1,000,000% mol/mol, 1,000% to 1,000,000% mol/mol or 10,000% to 1,000,000% mol/mol. Each possibility represents a separate embodiment of the invention and including each value and sub-range within the specified range.

It is to be understood that "molar excess of X %" as used herein means that the total mole amount of transition metal oxide eventually added in step (a) surpasses the mole amount of the alkali metal used by X %. for example, if the reaction of step (b) begins with 10 moles of sodium metal in a reactor and 100 moles of $Fe_2O_3$ are added to the reactor over the course of 5 hours until ceasing the reaction, it is said that the transition metal oxide, $Fe_2O_3$, was added at a 900% molar excess over the alkali metal.

According to some embodiments, the at least one transition metal is selected from the group consisting of: $Sc_2O_3$, $TiO_2$, $Ti_2O_3$, VO, $V_2O_3$, $VO_2$, $V_2O_5$, $Cr_2O_3$, CrO, $CrO_3$, MnO, $Mn_3O_4$, $Mn_2O_3$, $MnO_2$, $Mn_2O_7$, $Fe_2O_3$, FeO, $Fe_3O_4$, CoO, $Co_2O_3$, $Co_3O_4$, NiO, $Cu_2O$, CuO, $CuO_2$, ZnO and any combination thereof. Each possibility represents a separate embodiment of the invention.

According to some embodiments, $M^T{}_nO_m$ comprises $Sc_2O_3$.

According to some embodiments, $M^T{}_nO_m$ comprises $TiO_2$, $Ti_2O_3$ or a combination thereof. According to some embodiments, $M^T{}_nO_m$ comprises $TiO_2$. According to some embodiments, $M^T{}_nO_m$ comprises $Ti_2O_3$. According to some embodiments, $M^T{}_nO_m$ comprises a mixture of titanium oxides.

According to some embodiments, $M^T{}_nO_m$ comprises VO, $V_2O_3$, $VO_2$, $V_2O_5$ or a combination thereof. According to some embodiments, $M^T{}_nO_m$ comprises VO. According to some embodiments, $M^T{}_nO_m$ comprises $V_2O_3$. According to some embodiments, $M^T{}_nO_m$ comprises $VO_2$. According to some embodiments, $M^T{}_nO_m$ comprises $V_2O_5$. According to some embodiments, $M^T{}_nO_m$ comprises a mixture of vanadium oxides.

According to some embodiments, $M^T{}_nO_m$ comprises $Cr_2O_3$, CrO, $CrO_3$ or a combination thereof. According to some embodiments, $M^T{}_nO_m$ comprises $Cr_2O_3$. According to some embodiments, $M^T{}_nO_m$ comprises CrO. According to some embodiments, $M^T{}_nO_m$ comprises $CrO_3$. According to some embodiments, $M^T{}_nO_m$ comprises a mixture of chromium oxides.

According to some embodiments, $M^T{}_nO_m$ comprises MnO, $Mn_3O_4$, $Mn_2O_3$, $MnO_2$, $Mn_2O_7$ or a combination thereof. According to some embodiments, $M^T{}_nO_m$ comprises MnO. According to some embodiments, $M^T{}_nO_m$ comprises $Mn_3O_4$. According to some embodiments, $M^T{}_nO_m$ comprises $Mn_2O_3$. According to some embodiments, $M^T{}_nO_m$ comprises $MnO_2$. According to some embodiments, $M^T{}_nO_m$ comprises $Mn_2O_7$. According to some embodiments, $M^T{}_nO_m$ comprises a mixture of manganese oxides.

According to some embodiments, $M^T{}_nO_m$ comprises $Fe_2O_3$, FeO, $Fe_3O_4$ or a combination thereof. According to some embodiments, $M^T{}_nO_m$ comprises $Fe_2O_3$. According to some embodiments, $M^T{}_nO_m$ comprises FeO. According to some embodiments, $M^T{}_nO_m$ comprises $Fe_3O_4$. According to some embodiments, $M^T{}_nO_m$ comprises a mixture of iron oxides.

According to some embodiments, $M^T{}_nO_m$ comprises $Co_2O_3$, CoO, $Co_3O_4$ or a combination thereof. According to some embodiments, $M^T{}_nO_m$ comprises $Co_2O_3$. According to some embodiments, $M^T{}_nO_m$ comprises CoO. According to some embodiments, $M^T{}_nO_m$ comprises $Co_3O_4$. According to some embodiments, $M^T{}_nO_m$ comprises a mixture of cobalt oxides.

According to some embodiments, $M^T{}_nO_m$ comprises NiO.

According to some embodiments, $M^T{}_nO_m$ comprises $Cu_2O$, CuO, $CuO_2$ or a combination thereof. According to some embodiments, $M^T{}_nO_m$ comprises $Cu_2O$. According to some embodiments, $M^T{}_nO_m$ comprises CuO. According to some embodiments, $M^T{}_nO_m$ comprises $CuO_2$. According to some embodiments, $M^T{}_nO_m$ comprises a mixture of copper oxides.

According to some embodiments, $M^T{}_nO_m$ comprises ZnO.

Specific reference is now made to step (b) of the present process, which comprises combining the transition metal oxide with an alkali metal ($M^A$) in a reactor, and adjusting the temperature within the reactor to temperature T or above, to induce the two-reaction sequence of schemes I and II, according to some embodiments.

According to some embodiments, step (b) comprises reacting the transition metal oxide with the alkali metal at temperature T. According to some embodiments, step (b) comprises reacting the transition metal oxide with the alkali metal at temperature T or above.

According to some embodiments, step (b) comprises combining the transition metal oxide with an alkali metal ($M^A$). According to some embodiments, the action of combining the transition metal oxide with an alkali metal is performed at temperature T. Specifically, in the case that the reaction has not yet started, external heating is required to reach temperature T, according to some embodiments. Alternatively, after the reaction has begun, its exothermicity can at least partially maintain or elevate the internal temperature, so that less external heating is required or even the external heating may be at least temporarily ceased, according to some embodiments.

According to some embodiments, the combination of the transition metal oxide and alkali metal at temperature T in a reactor, induces the two-reaction sequence of reaction schemes I and II:

$$M^T{}_nO_m + 2m \times M^A \rightarrow m \times M^A{}_2O + n \times M^T; \quad \text{I:}$$

$$M^A{}_2O \rightarrow 2 \times M^A + 0.5O_2; \quad \text{II:}$$

According to some embodiments, the combination of the transition metal oxide and alkali metal at temperature T in a reactor, causes the two-reaction sequence of schemes I and II.

According to some embodiments, the combination of reaction schemes I and II (multiplied by m) results in a net reaction, represented by reaction Scheme III:

$$M^T{}_nO_m + 2m \times M^A \rightarrow m \times M^A{}_2O + n \times M^T; \quad \text{I:}$$

$$m \times M^A{}_2O \rightarrow 2m \times M^A + 0.5m \times O_2. \quad \text{II}\times\text{m:}$$

$$M^T{}_nO_m \rightarrow n \times M^T + 0.5m \times O_2. \quad \text{III:}$$

It is to be understood that in order to balance and subtract the equations of Schemes I and II, the equation of Scheme II needs to be multiplied by m (the number of oxygen atoms in the transition metal oxide compound).

According to some embodiments, the value of temperature T is selected such that the reactions of schemes I and II are conducted. In other words, the temperature T brings enough energy to the reaction system to surpass the activation energy of both reactions and provides adequate reaction conditions.

For the reaction of Scheme I, a key parameter is the physical state of the reactants, according to some embodiments. Specifically, according to some embodiments, it is advantageous that the reactions of the present method are conducted neat (i.e., without any solvents). Also, at room temperature both the alkali metal and the transition metal oxide reactants are in the solid state, which tends to slow-down or prevent chemical reactions. Thus, according to some embodiments, temperature T is above the melting point of the alkali metal. According to some embodiments, at temperature T the alkali metal is at a fluid state. According to some embodiments, at temperature T the alkali metal is at a liquid state. According to some embodiments, at temperature T the alkali metal is at a gas state.

For the reaction of Scheme II, a key parameter is the activation energy required to decompose the alkali metal oxide, according to some embodiments. Therefore, according to some embodiments, temperature T is equal or above the decomposition temperature of $M^A{}_2O$. According to some embodiments, temperature T is above the decomposition temperature of $M^A{}_2O$.

The term "alkali metal" as used herein cover any compound that includes an alkali metal at its 0 (zero) oxidation state. Thus, this term includes sodium metal, Na(0), and potassium metal, K(0), as well as alloys thereof, where at least one alkali metal at its zero oxidation state, e.g., NaK.

According to some embodiments, wherein alkali metal ($M^A$) is Na or K. According to some embodiments, the alkali metal is Na. According to some embodiments, the alkali metal is K. According to some embodiments, the alkali metal is NaK.

Sodium-potassium alloy, colloquially called NaK is an alloy of the alkali metals sodium potassium that is normally liquid at room temperature.

According to some embodiments, temperature T is at least 300° C., at least 350° C., at least 400° C., at least 450° C., at least 500° C., at least 540° C., at least 600° C., at least 700° C., at least 800° C. or at least 900° C. Each possibility represents a separate embodiment of the invention. According to some embodiments, temperature T is in the range of 300° C. to 3,000° C., 540° C. to 3,000° C. or 900° C. to 3,000° C. Each possibility represents a separate embodiment of the invention and including each value and sub-range within the specified range.

According to some embodiments, the alkali metal is sodium and temperature T is above the melting point of sodium. According to some embodiments, the alkali metal is sodium and at temperature T sodium is at a fluid state. According to some embodiments, the alkali metal is sodium and at temperature T sodium is at a liquid state. According to some embodiments, the alkali metal is sodium and at temperature T sodium is at a gas state. At standard conditions, the boiling and melting points of sodium are 97.8° C. and 883° C. respectively and the decomposition temperature of $Na_2O$ is 540° C. According to some embodiments, the alkali metal is sodium and T is at least 100° C. According to some embodiments, the alkali metal is sodium and T is at least 540° C. According to some embodiments, the alkali metal is sodium and T is at least 883° C.

According to some embodiments, the alkali metal is potassium and temperature T is above the melting point of potassium. According to some embodiments, the alkali metal is potassium and at temperature T potassium is at a fluid state. According to some embodiments, the alkali metal is potassium and at temperature T potassium is at a liquid state. According to some embodiments, the alkali metal is potassium and at temperature T potassium is at a gas state. At standard conditions, the boiling and melting points of potassium are 63.5° C. and 758.8° C. respectively and the decomposition temperature of $K_2O$ is 300° C. According to some embodiments, the alkali metal is potassium and T is at least 63° C. According to some embodiments, the alkali metal is potassium and T is at least 758.8° C. According to some embodiments, the alkali metal is potassium and T is at least 300° C.

According to some embodiments, the reaction of Scheme I is conducted neat. According to some embodiments, the reaction of Scheme II is conducted neat. According to some embodiments, the two-reaction sequence of step (b) is conducted neat.

According to some embodiments, the reaction mixture of step (b) is substantially devoid of additional solvents. According to some embodiments, the reaction mixture of step (b) is substantially devoid of additional solvents and carriers.

The term "solvent" refers to a non-reactive component of a composition that reduces the viscosity of the composition. Typically, a solvent has a volatility such that it is removed under work-up conditions (such as elevated temperature and/or reduced pressure), after the conclusion of a chemical reaction. The term "substantially devoid solvents" or "solvent-free" refers to a composition that does not contain a solvent, or substantially does not contain a solvent, as defined above. Compositions that substantially do not contain a solvent can contain trace amount, such as ≤5% w/w≤3% w/w,≤2% w/w.≤1% or ≤0.5% w/w of solvent according to some embodiments.

According to some embodiments, the reaction mixture of step (b) is consisting essentially of the transition metal oxide, the alkali metal and the product reduced transition metal or alloy thereof. According to some embodiments, the condensed phase within the reactor during step (b) is consisting essentially of the transition metal oxide, the alkali metal and the product reduced transition metal or alloy thereof.

The term "consisting essentially of" means that the reaction mixture of step (b) includes mainly the transition metal oxide, the alkali metal and the product reduced transition metal or alloy thereof. Specifically, it does not include substantial amounts of solvents or carrier or any constituent that is not involved in reaction Schemes I and II, according to some embodiments. According to some embodiments, the reaction mixture of step (b) includes no more than 5% w/w, no more than 3% w/w, no more than 2% w/w or no more than 1% w/w other compounds. Each possibility represents a separate embodiment of the invention. Other compounds may include impurities from the production or mining of the transition metal oxide.

According to some embodiments, net reaction, III, resulting from said two-reaction sequence does not consume the alkali metal. According to some embodiments, the alkali metal is used as a catalyst in the two-reaction sequence of step (b). According to some embodiments, the alkali metal is recycled in the two-reaction sequence of step (b).

It is to be understood that while the net reaction III does not consume the alkali metal, some of the alkali metal may be gradually consumed during step (b). Specifically, side reactions which may take place when the transition metal oxide is impure or of lower grade, may gradually consume at least some of the alkali metal. Yet, the specific net reaction III does not consume the alkali metal.

According to some embodiments, the resulting reaction mixture formed upon contacting the transition metal oxide and alkali metal in step (b) is in a fluid state. According to some embodiments, the resulting reaction mixture formed upon contacting the transition metal oxide and alkali metal in step (b) is in a liquid state. According to some embodiments, the resulting reaction mixture formed upon contacting the transition metal oxide and alkali metal in step (b) is a heterogenous mixture. According to some embodiments, the resulting reaction mixture formed upon contacting the transition metal oxide and alkali metal in step (b) is a liquid-solid, liquid-liquid, gas-solid or gas-liquid heterogenous mixture. Each possibility represents a separate embodiment of the invention.

According to some embodiments, the reaction mixture formed upon conducting the two-reaction sequence of step (b) comprises the reduced transition metal, $M^T$, or alloy thereof. According to some embodiments, the reaction mixture formed upon conducting the two-reaction sequence of step (b) further comprises oxygen. According to some embodiments, oxygen gas is separated from the reaction mixture.

According to some embodiments, the reaction mixture of step (b) contains no metals or metal oxides, which are alloyable with the transition metal provided in step (a).

According to some embodiments, the reaction mixture of step (b) contains alloyable metals or metal oxides, which are alloyable with the transition metal provided in step (a). This is elaborated below when relating to the optional alloy formation.

As detailed herein, step (a) may involve continuous addition of transition metal oxide to the reaction mixture of step (b) so that over the entire course of step (b) the transition metal oxide is provided in a molar excess over the alkali metal added. Specifically, according to some embodiments, the transition metal oxide added to the reactor over the course of step (b) is in molar excess of the alkali metal added thereto. Specific excesses are specified above.

However, the transition metal oxide added to the reactor is consumed through the reaction of scheme I, while the alkali metal is recycled through the reaction of scheme I. Therefore, according to some embodiments, at any specific time during step (b) the alkali metal within the reactor is in molar excess over the transition metal oxide. According to some embodiments, the transition metal oxide is continuously provided to the reactor at an addition rate, which ensures that the alkali metal within the reactor is in molar excess over the transition metal oxide at any specific time during step (b). According to some embodiments, the molar excess is at least 5%, least 10%, least 25%, least 50%, least 100% or least 200%. Each possibility represents a separate embodiment of the invention.

According to some embodiments, the two-reaction sequence of step (b) is conducted in an air-protected environment. According to some embodiments, the two-reaction sequence of step (b) is conducted in a water-protected environment. According to some embodiments, the two-reaction sequence of step (b) is conducted in an air and water protected environment.

Specifically, it is to be understood that alkali metals are highly reactive and require specific reaction conditions, such as performance under inert gas.

According to some embodiments, step (b) further comprises flowing inert gas into the reactor. According to some embodiments, the two-reaction sequence of step (b) is performed under inert gas. According to some embodiments, the inert gas in nitrogen or argon.

According to some embodiments, during step (b) the reactor is closed. According to some embodiments, during step (b) the reactor is closed under an inert atmosphere. According to some embodiments, during step (b) the reactor is closed under an inert gas atmosphere. According to some embodiments, during step (b) the reactor is closed and the two-reaction sequence is performed at an elevated pressure.

The term "elevated pressure" refers to any pressure above atmospheric pressure.

Advantageously, the reaction duration is short, which is both economical and energy-consuming.

According to some embodiments, step (b) is performed for no more than 6 hours, no more than 4 hours, no more than 3 hours, no more than 2 hours, no more than 1 hour, no more than 45 minutes, or no more than 30 minutes. Each possibility represents a separate embodiment of the invention. According to some embodiments, step (b) is performed for no more than 1 hour. According to some embodiments, step (b) is performed for at least 5 minutes, at least 10 minutes, at least 15 minutes, at least 20 minutes or at least 25 minutes. Each possibility represents a separate embodiment of the invention.

It is to be understood that reference to the duration of step (b) refers to an individual run of step (b). Specifically, as detailed herein, according to some embodiments, the present process is performed cyclically, with the alkali metal recycled after the completion of the reaction, back to be re-used in a subsequent run of step (b). thus, it is to be understood that repeats of step (b) are allowed to cumulatively surpass the bottom threshold set above, without contradicting the above clause, which is directed to the individual run of step (b)

Specific reference is now made to step (c) of the present process, which comprises isolating the reduced transition metal or alloy thereof, according to some embodiments.

According to some embodiments, step (c) comprises isolating the reduced transition metal or alloy thereof, from the reaction mixture. According to some embodiments, step (c) comprises isolating the reduced transition metal from the reaction mixture. According to some embodiments, step (c) comprises isolating the reduced transition metal alloy from the reaction mixture.

According to some embodiments, the isolated reduced transition metal or alloy thereof is a condensed phase. According to some embodiments, the isolated reduced transition metal or alloy thereof is isolated as a solid. According to some embodiments, the isolated reduced transition metal or alloy thereof is isolated as a liquid.

According to some embodiments, the isolation of step (c) entails evaporating the alkali metal produced in reaction scheme II and transferring the alkali metal out of the reactor, so that the reactor remains with the reduced transition metal or alloy thereof. According to some embodiments, the evaporation involves heating the alkali metal. According to some embodiments, the evaporation involves reducing the pressure within the reactor. According to some embodiments, the isolation of step (c) entails evaporating the alkali metal from the reactor. According to some embodiments, the isolation of step (c) entails boiling the alkali metal from the reactor.

According to some embodiments, transferring the alkali metal as a gas from the reactor produces an isolated transition metal or alloy thereof.

According to some embodiments, step (c) comprises isolating the transition metal or alloy thereof at a purity of at least 70% w/w, at least 80% w/w, at least 90% w/w, at least 95% w/w, or at least 99% w/w. Each possibility represents a separate embodiment of the invention.

According to some embodiments, step (c) comprises evaporating the alkali metal and oxygen from the reactor to produce an isolated transition metal or alloy thereof at a purity of at least 70% w/w, at least 80% w/w, at least 90% w/w, at least 95% w/w, or at least 99% w/w. Each possibility represents a separate embodiment of the invention.

The purity may be conveniently determined by X-ray diffraction (XRD), as exemplified herein.

Specifically, it was found that when starting with pure transition metal oxides, the product produced by the process of the present invention is substantially pure even when isolated as crude. However, some transition metals are reactive to air, such that upon isolation they require protection from air.

According to some embodiments, the transition metal is Fe, Co, Ni or Cu, and the purity is of at least 99% w/w. Each possibility represents a separate embodiment of the invention.

Also, in industrial processes, the transition metal oxides may be provided from ores, which contain contaminants, such as silicon oxides. When providing such transition metal oxide compositions in step (a) of the present process, they may not react and the contaminants may be separated using an additional step of melting the transition metal product and filtering/skimming off the contaminants.

Specific reference is now made to step (d) of the present process, which is optional and comprises collecting the isolated transition metal or alloy thereof.

Specifically, according to some embodiments, the process further comprises collecting the isolated transition metal or alloy thereof produced in step (c).

According to some embodiments, the isolation of step (c) entails evaporating the alkali metal from the reactor; and the process further comprises step (d) of collecting the isolated transition metal or alloy thereof.

According to some embodiments, step (d) further comprises placing the isolated reduced transition metal or alloy thereof in a dedicated container. According to some embodiments, the container is kept at air- and/or water-protected conditions. According to some embodiments, the container is a sealable container. The transition metal container is discussed below with respect to the system.

Specific reference is now made to step (e) of the present process, which is optional and comprises condensing the alkali metal evaporated during step (c).

According to some embodiments, the process further comprises step (e) of condensing the evaporated alkali metal. According to some embodiments, the evaporated alkali metal is condensed in a dedicated container. According to some embodiments, the container is kept at air- and/or water-protected conditions. According to some embodiments, the container is a sealable container. The alkali metal container is discussed below with respect to the system.

In general, alkali metals are solid materials at room temperature and atmospheric pressure. In step (c) the alkali metals are heated, and optionally put in reduced pressure, so that they transform into vapor, according to some embodiments. Step (e) is relevant when the isolation of step (c) comprises such vaporization, and it comprises the condensation of the alkali metal vapor in a separate container, according to some embodiments. Although the term "condense" typically refers to the transformation from gas to liquid, it is to be understood that the condensed alkali metals may gradually or instantaneously transform into solids, depending, e.g., on the temperature in the alkali metal container. Thus, the term "condense" in the context of step (e) further comprises deposition of gas to solid.

Also, it is to be appreciated by the person having ordinary skill in the art that since step (d) involves treatment of the transition metal or alloy, and step (e) involves treatment of the alkali metal, these steps are individual so that step (d) may precede step (e), step (e) may precede step (d), or they can be performed simultaneously.

According to some embodiments, step (d) precedes step (e), step (e) precedes step (d), or steps (d) and (e) are performed simultaneously. According to some embodiments, step (d) precedes step (e). According to some embodiments, step (e) precedes step (d), Specific reference is now made to step (f) of the present process, which is optional when step (e) is conducted and comprises transferring the alkali metal condensed in step (e) back into the reactor.

Specifically, in the step (c) the alkali metal is optionally removed from the reactor, so as to isolate and collect (in optional step (d)) the formed transition metal or alloy, according to some embodiments. Thereafter, in order to complete the recycling of the alkali metal, the removed alkali metal may be placed back in the reactor, for further reactions according to the present reaction sequence, according to some embodiments. This is performed in step (f), which transfers the alkali metal back to the reactor.

According to some embodiments, the alkali metal is transferred to the reactor in step (f) as a condensed material. According to some embodiments, the alkali metal is transferred to the reactor in step (f) as a liquid. According to some embodiments, the alkali metal is transferred to the reactor in step (f) as a solid.

Thus, according to some embodiments, the process further comprises step (e) of condensing the evaporated alkali metal in an alkali metal container; and step (f) of transferring the condensed alkali metal into the reactor, thereby recycling the alkali metal.

It is to be understood that by performing step (f), one cycle of the present process is complete. Upon the reconstitution of alkali metal and additional provision of transition metal, the process may continue to an additional cycle, according to some embodiments.

According to some embodiments, the process further comprises repeating steps (a)-(d) for at least one additional sequence after step (f). According to some embodiments, the process further comprises repeating steps (a)-(c) for at least one additional sequence after step (f). According to some embodiments, the process further comprises repeating steps (a)-(d) for at least one additional sequence.

According to some embodiments, the process comprises: performing steps (a)-(f) for at least one cycle and performing steps (a)-(c). According to some embodiments, the process comprises: performing steps (a)-(f) for a plurality of cycles and performing steps (a)-(c).

The term "plurality" refers to any integer higher than 1.

Figure 2:
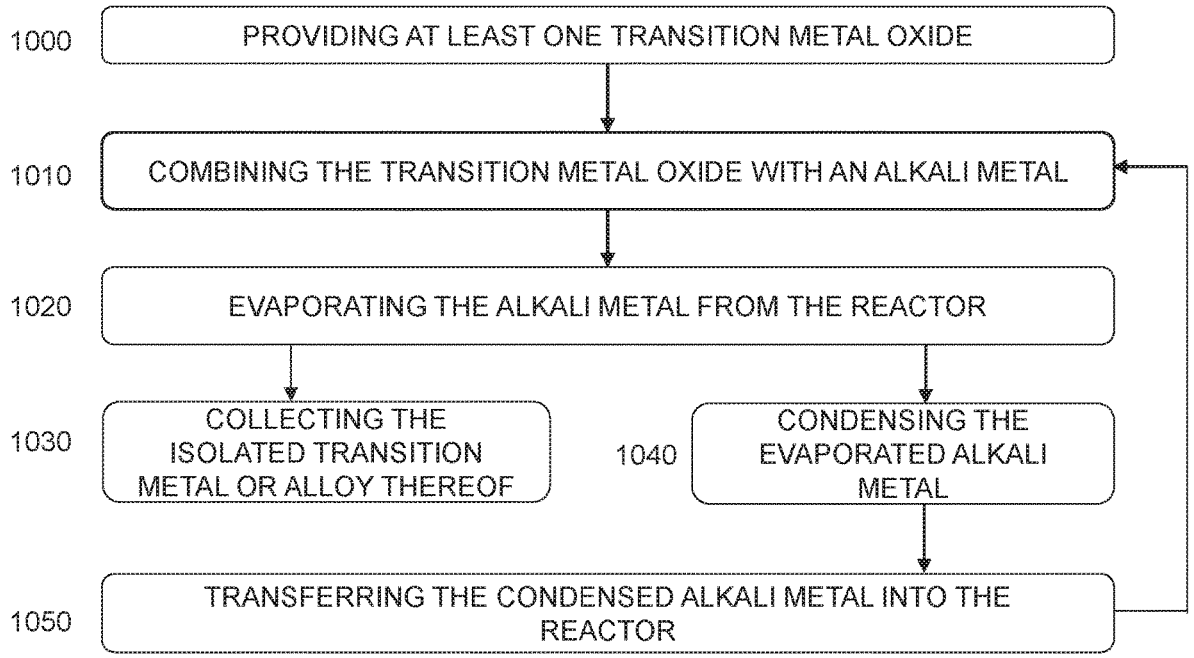
FIG. 2 is a block diagram representing a process for the reduction of at least one transition metal oxide into the corresponding transition metal or alloy thereof, according to some embodiments.

Reference is now made to FIGS. 1-2, which are block diagrams representing a process for the reduction of at least one transition metal oxide into the corresponding transition metal or alloy thereof.

Specifically, FIG. 1 is a block diagram representing a process for the reduction of at least one transition metal oxide into the corresponding transition metal or alloy thereof, which comprises steps (a), (b) and (c) as detailed herein, according to some embodiments. Step (a) is represented by block 1000, step (b) is represented by block 1010 and step (c) is represented by block 1020.

Similarly, FIG. 2 is a block diagram representing a process for the reduction of at least one transition metal oxide into the corresponding transition metal or alloy thereof, which comprises steps (a), (b), (c), (d), (e) and (f) as detailed herein, according to some embodiments. Step (a) is represented by block 1000, step (b) is represented by block 1010, step (c) is represented by block 1020, step (d) is represented by block 1030, step (e) is represented by block 1040 and step (f) is represented by block 1050.

Figure 3:
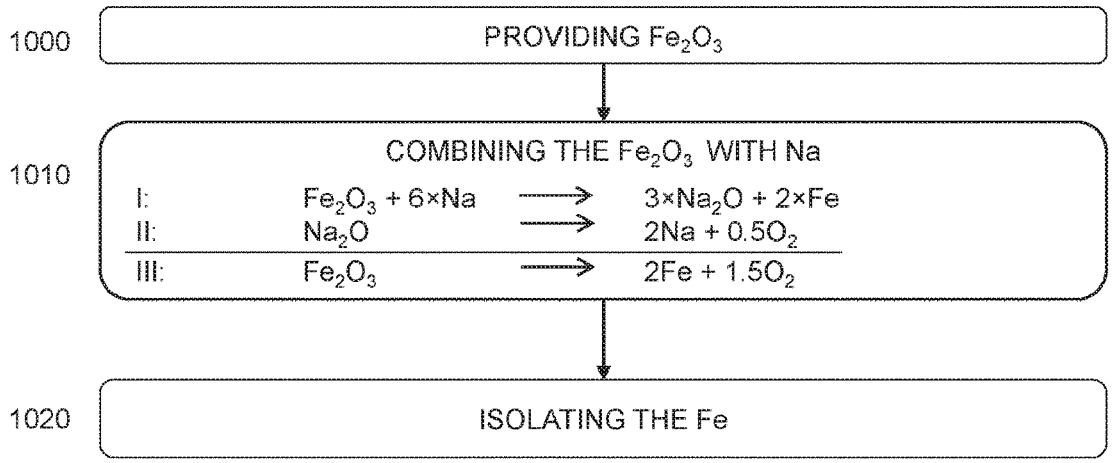
FIG. 3 is a block diagram representing a process for the reduction of $Fe_2O_3$ into iron metal, according to some embodiments.
Figure 4:
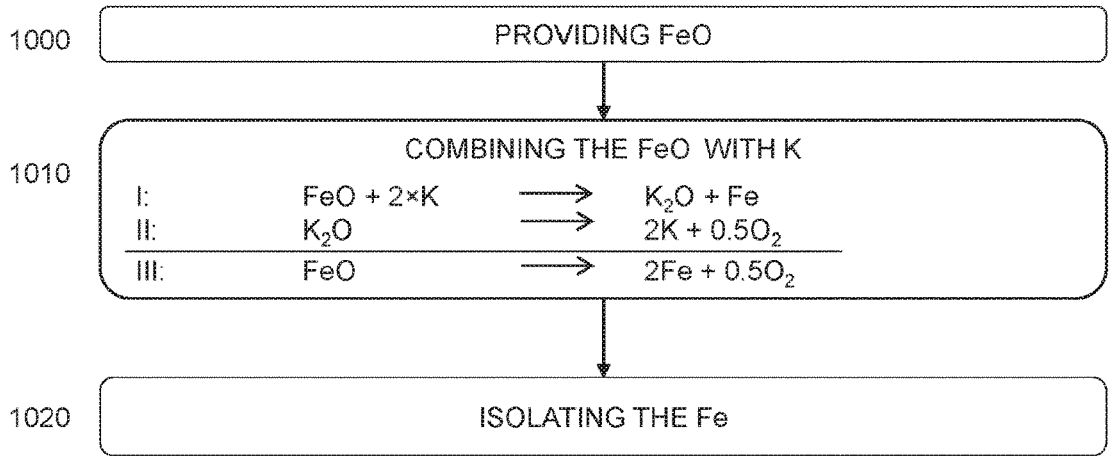
FIG. 4 is a block diagram representing a process for the reduction of FeO into iron metal, according to some embodiments.
Figure 5:
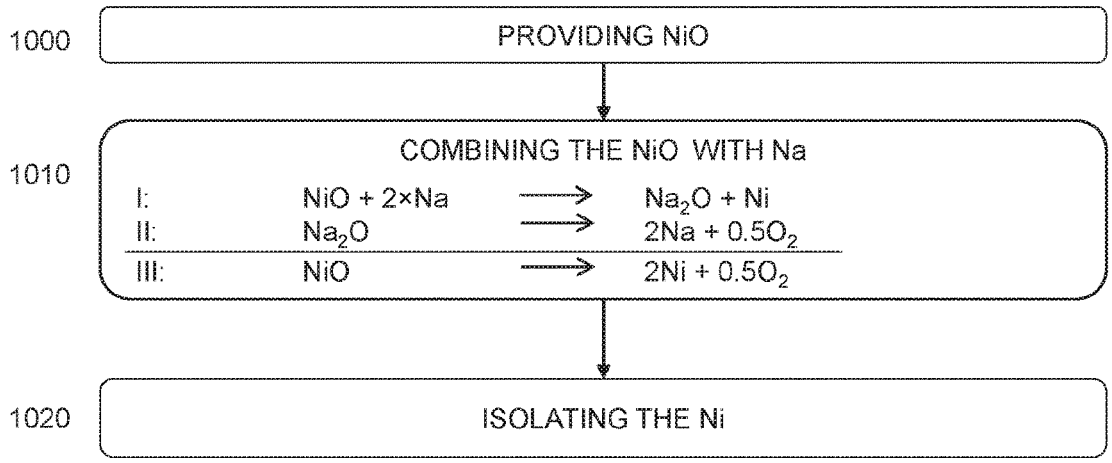
FIG. 5 is a block diagram representing a process for the reduction of NiO into nickel metal, according to some embodiments.

Below are provided non-limiting specific embodiments of specific reaction sequences, which can be conducted by the process of the present invention. Reference in further made to FIGS. 3-9, which are block diagrams, each representing a selected process for the reduction of at least one transition metal oxide into the corresponding transition metal or alloy thereof (i.e., a specific two-reaction sequence). Each one of FIGS. 3-5 represent a process comprising steps (a), (b) and (c) as detailed herein, according to some embodiments, wherein step (a) is represented by block 1000, step (b) is represented by block 1010 and step (c) is represented by block 1020. Each one of FIGS. 6-9 represent a process comprising steps (a), (b), (c), (d), (e) and (f) as detailed herein, according to some embodiments, wherein step (a) is represented by block 1000, step (b) is represented by block 1010, step (c) is represented by block 1020, step (d) is represented by block 1030, step (e) is represented by block 1040 and step (f) is represented by block 1050.

According to some embodiments, the alkali metal is Na and scheme II is:

$$Na_2O \rightarrow 2Na + 0.5O_2. \quad \text{II:}$$

FIGS. 3, 5, 6 and 7 refer to reaction sequences, which employ sodium as the alkali metal.

According to some embodiments, the alkali metal is K and scheme II is:

$$K_2O \rightarrow 2K + 0.5O_2. \quad \text{II:}$$

Figure 8:
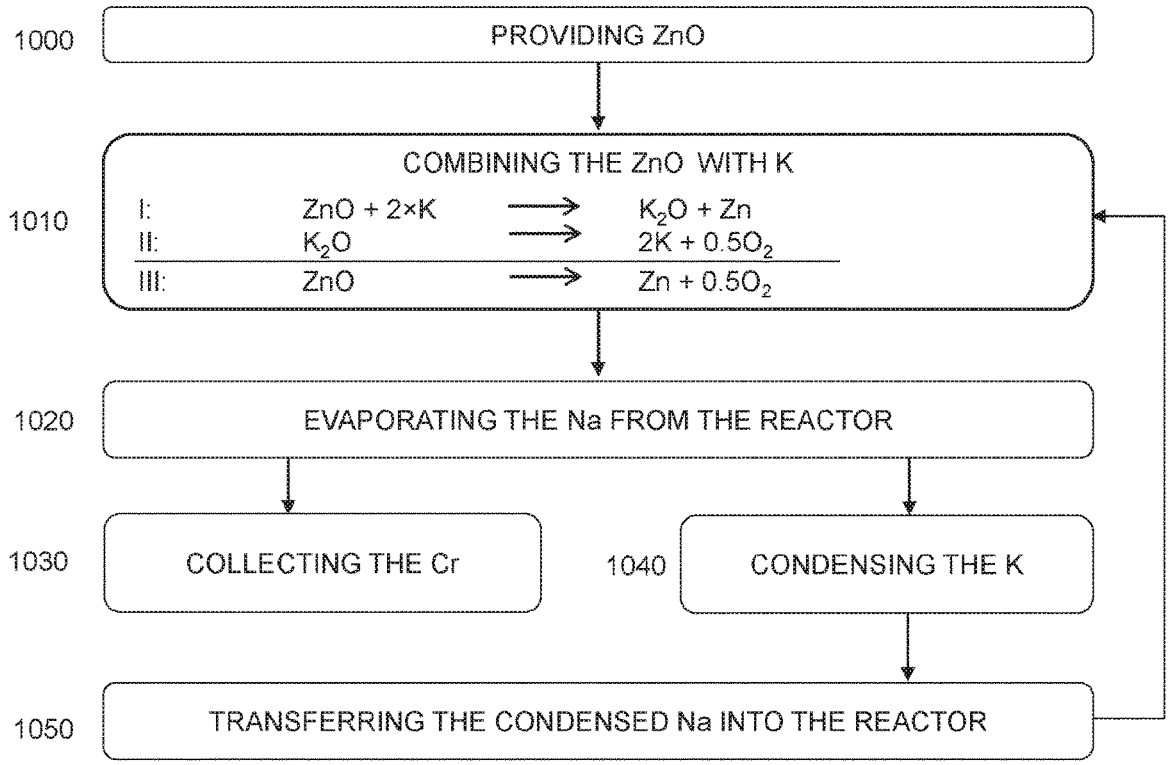
FIG. 8 is a block diagram representing a process for the reduction of ZnO into zinc metal, according to some embodiments.
Figure 9:
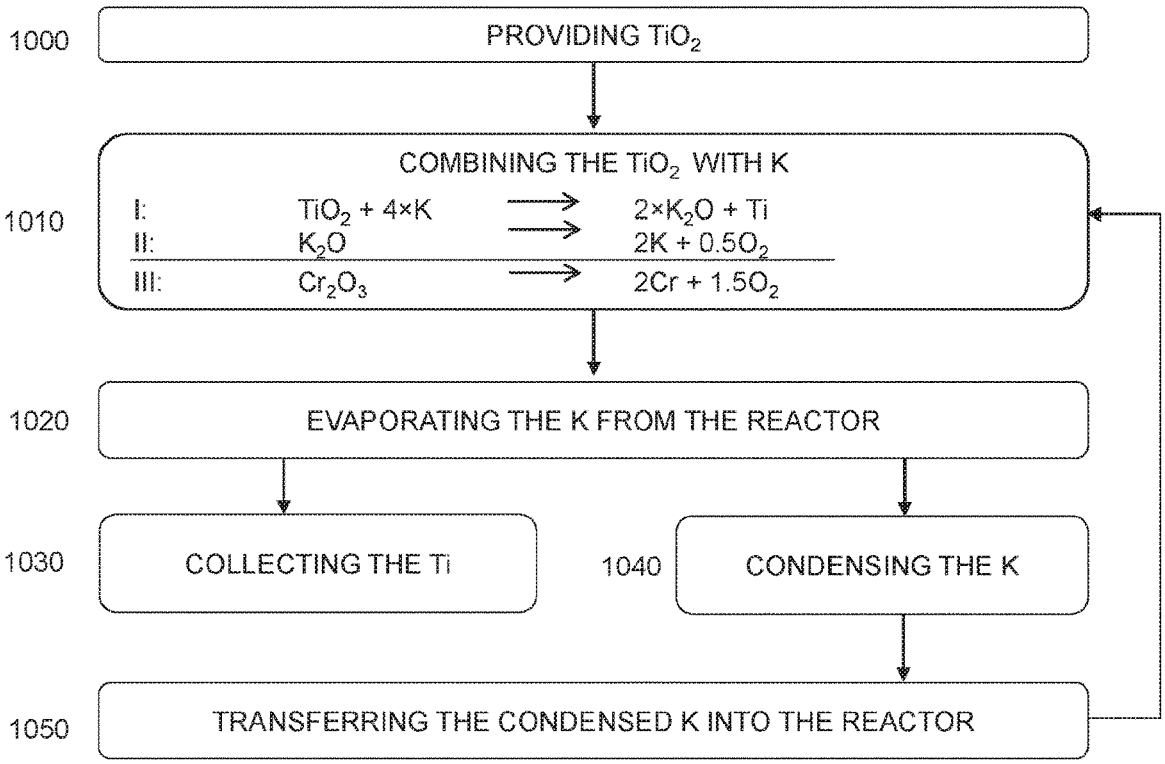
FIG. 9 is a block diagram representing a process for the reduction of $TiO_2$ into titanium metal, according to some embodiments.

FIGS. 4, 8 and 9 refer to reaction sequences, which employ potassium as the alkali metal.

According to some embodiments, $M^T$ is Fe; $M^T{}_nO_m$ is $Fe_2O_3$, $M^A$ is Na and reaction schemes I and III are:

$$Fe_2O_3 + 6\times Na \rightarrow 3\times Na_2O + 2\times Fe; \quad \text{I:}$$

$$Fe_2O_3 \rightarrow 2\times Fe + 1.5\times O_2. \quad \text{III:}$$

This transformation is portrayed in FIG. 3.

Also, reaction Scheme II for $M^A$=Na is provided above and can be appreciated by the person having ordinary skill in the art in each of the reaction sequences below.

According to some embodiments, $M^T$ is Fe; $M^T{}_nO_m$ is $Fe_2O_3$, $M^A$ is K and reaction schemes I and III are:

$$Fe_2O_3 + 6\times K \rightarrow 3\times K_2O + 2\times Fe; \quad \text{I:}$$

$$Fe_2O_3 \rightarrow 2\times Fe + 1.5\times O_2. \quad \text{III:}$$

Also, reaction Scheme II for $M^A$=K is provided above and can be appreciated by the person having ordinary skill in the art in each of the reaction sequences below.

According to some embodiments, $M^T$ is Fe; $M^T{}_nO_m$ is FeO, $M^A$ is Na and reaction schemes I and III are:

$$FeO + 2\times Na \rightarrow Na_2O + Fe; \quad \text{I:}$$

$$FeO \rightarrow Fe + 0.5\times O_2. \quad \text{III:}$$

According to some embodiments, $M^T$ is Fe; $M^T{}_nO_m$ is FeO, $M^A$ is K and reaction schemes I and III are:

$$FeO + 2\times K \rightarrow K_2O + Fe; \quad \text{I:}$$

$$FeO \rightarrow Fe + 0.5\times O_2. \quad \text{III:}$$

This transformation is portrayed in FIG. 4.

According to some embodiments, $M^T$ is Fe; $M^T{}_nO_m$ is $Fe_3O_4$, $M^A$ is Na and reaction schemes I and III are:

$$Fe_3O_4 + 8\times Na \rightarrow 4\times Na_2O + 3\times Fe; \quad \text{I:}$$

$$Fe_3O_4 \rightarrow 3\times Fe + 2\times O_2. \quad \text{III:}$$

According to some embodiments, $M^T$ is Fe; $M^T{}_nO_m$ is $Fe_3O_4$, $M^A$ is K and reaction schemes I and III are:

$$Fe_3O_4 + 8\times K \rightarrow 4\times K_2O + 3\times Fe; \quad \text{I:}$$

$$Fe_3O_4 \rightarrow 3\times Fe + 2\times O_2. \quad \text{III:}$$

According to some embodiments, $M^T$ is Ni; $M^T{}_nO_m$ is NiO, $M^A$ is Na and reaction schemes I and III are:

$$NiO + 2\times Na \rightarrow Na_2O + Ni; \quad \text{I:}$$

$$NiO \rightarrow Ni + 0.5\times O_2. \quad \text{III:}$$

This transformation is portrayed in FIG. 5.

According to some embodiments, $M^T$ is Ni; $M^T{}_nO_m$ is NiO, $M^A$ is K and reaction schemes I and III are:

$$NiO + 2\times K \rightarrow K_2O + Ni; \quad \text{I:}$$

$$NiO \rightarrow Ni + 0.5\times O_2. \quad \text{III:}$$

According to some embodiments, $M^T$ is Cr; $M^T{}_nO_m$ is $Cr_2O_3$, $M^A$ is Na and reaction schemes I and III are:

$$Cr_2O_3 + 6\times Na \rightarrow 3\times Na_2O + 2\times Cr; \quad \text{I:}$$

$$Cr_2O_3 \rightarrow 2\times Cr + 1.5\times O_2. \quad \text{III:}$$

Figure 6:
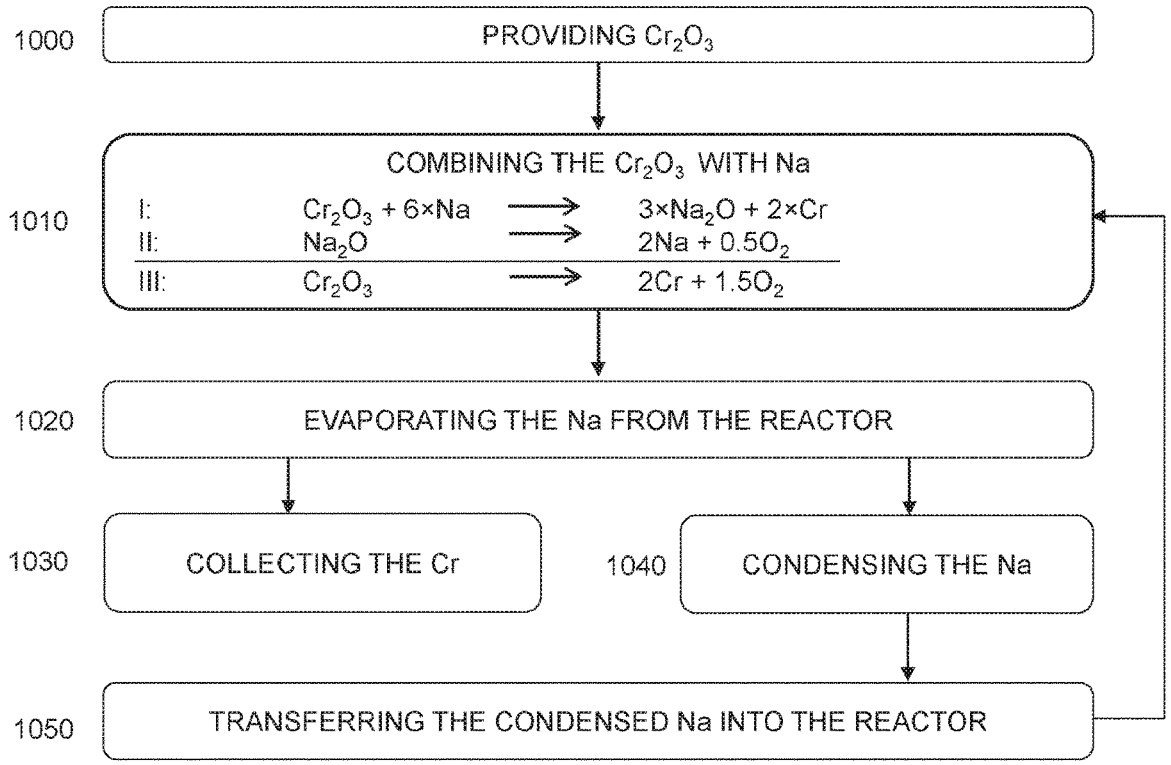
FIG. 6 is a block diagram representing a process for the reduction of $Cr_2O_3$ into chromium metal, according to some embodiments.

This transformation is illustrated in FIG. 6.

According to some embodiments, $M^T$ is Cr; $M^T{}_nO_m$ is $Cr_2O_3$, $M^A$ is K and reaction schemes I and III are:

$$Cr_2O_3 + 6\times K \rightarrow 3\times K_2O + 2\times Cr; \quad \text{I:}$$

$$Cr_2O_3 \rightarrow 2\times Cr + 1.5\times O_2. \quad \text{III:}$$

According to some embodiments, $M^T$ is Cr; $M^T{}_nO_m$ is CrO, $M^A$ is Na and reaction schemes I and III are:

$$CrO + 2\times Na \rightarrow Na_2O + Cr; \quad \text{I:}$$

$$CrO \rightarrow Cr + 0.5\times O_2. \quad \text{III:}$$

According to some embodiments, $M^T$ is Cr; $M^T{}_nO_m$ is CrO, $M^A$ is K and reaction schemes I and III are:

$$CrO + 2\times K \rightarrow K_2O + Cr; \quad \text{I:}$$

$$CrO \rightarrow Cr + 0.5\times O_2. \quad \text{III:}$$

According to some embodiments, $M^T$ is Cr; $M^T{}_nO_m$ is $CrO_3$, $M^A$ is Na and reaction schemes I and III are:

$$CrO_3 + 6\times Na \rightarrow 3\times Na_2O + Cr; \quad \text{I:}$$

$$CrO_3 \rightarrow Cr + 1.5\times O_2. \quad \text{III:}$$

According to some embodiments, $M^T$ is Cr; $M^T_nO_m$ is $CrO_3$, $M^A$ is K and reaction schemes I and III are:

$$CrO_3+6\times K\rightarrow 3\times K_2O+Cr; \quad \text{I:}$$

$$CrO_3\rightarrow Cr+1.5\times O_2. \quad \text{III:}$$

According to some embodiments, $M^T$ is Cr; $M^T_nO_m$ is $Cu_2O$, $M^A$ is Na and reaction schemes I and III are:

$$Cu_2O+2\times Na\rightarrow Na_2O+2Cu; \quad \text{I:}$$

$$Cu_2O\rightarrow 2\times Cu+0.5\times O_2; \quad \text{III:}$$

According to some embodiments, $M^T$ is Cr; $M^T_nO_m$ is $Cu_2O$, $M^A$ is K and reaction schemes I and III are:

$$Cu_2O+2\times K\rightarrow K_2O+2Cu; \quad \text{I:}$$

$$Cu_2O\rightarrow 2\times Cu+0.5\times O_2; \quad \text{III:}$$

Figure 7:
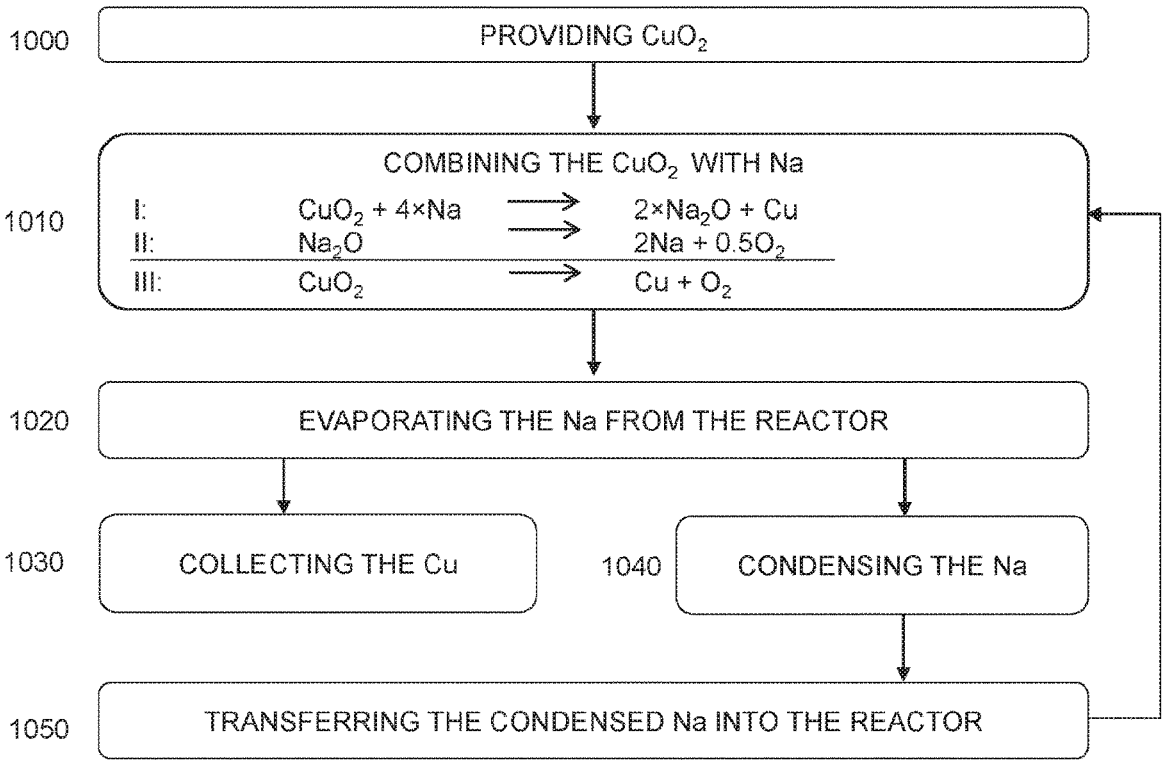
FIG. 7 is a block diagram representing a process for the reduction of $Cu_2O$ into copper metal, according to some embodiments.

This transformation is illustrated in FIG. 7.

According to some embodiments, $M^T$ is Cu; $M^T_nO_m$ is CuO, $M^A$ is Na and reaction schemes I and III are:

$$CuO+2\times Na\rightarrow Na_2O+Cu; \quad \text{I:}$$

$$CuO\rightarrow Cu+0.5\times O_2. \quad \text{III:}$$

According to some embodiments, $M^T$ is Cu; $M^T_nO_m$ is CuO, $M^A$ is K and reaction schemes I and III are:

$$CuO+2\times K\rightarrow K_2O+Cu; \quad \text{I:}$$

$$CuO\rightarrow Cu+0.5\times O_2. \quad \text{III:}$$

According to some embodiments, $M^T$ is Cu; $M^T_nO_m$ is $CuO_2$, $M^A$ is Na and reaction schemes I and III are:

$$CuO_2+4\times Na\rightarrow 2Na_2O+Cu; \quad \text{I:}$$

$$CuO_2\rightarrow Cu+O_2. \quad \text{III:}$$

According to some embodiments, $M^T$ is Cu; $M^T_nO_m$ is $CuO_2$, $M^A$ is K and reaction schemes I and III are:

$$CuO_2+4\times K\rightarrow 2K_2O+Cu; \quad \text{I:}$$

$$CuO_2\rightarrow Cu+O_2. \quad \text{III:}$$

According to some embodiments, $M^T$ is Zn; $M^T_nO_m$ is ZnO, $M^A$ is Na and reaction schemes I and III are:

$$ZnO+2\times Na\rightarrow Na_2O+Zn; \quad \text{I:}$$

$$ZnO\rightarrow Zn+0.5\times O_2. \quad \text{III:}$$

This transformation is illustrated in FIG. 8.

According to some embodiments, $M^T$ is Zn; $M^T_nO_m$ is ZnO, $M^A$ is K and reaction schemes I and III are:

$$ZnO+2\times K\rightarrow K_2O+Zn; \quad \text{I:}$$

$$ZnO\rightarrow Zn+0.5\times O_2. \quad \text{III:}$$

According to some embodiments, $M^T$ is Mn; $M^T_nO_m$ is MnO, $M^A$ is Na and reaction schemes I and III are:

$$MnO+2\times Na\rightarrow Na_2O+Mn; \quad \text{I:}$$

$$MnO\rightarrow Mn+0.5\times O_2. \quad \text{III:}$$

According to some embodiments, $M^T$ is Mn; $M^T_nO_m$ is MnO, $M^A$ is K and reaction schemes I and III are:

$$MnO+2\times K\rightarrow K_2O+Mn; \quad \text{I:}$$

$$MnO\rightarrow Mn+0.5\times O_2. \quad \text{III:}$$

According to some embodiments, $M^T$ is Mn; $M^T_nO_m$ is $Mn_3O_4$, $M^A$ is Na and reaction schemes I and III are:

$$Mn_3O_4+8\times Na\rightarrow 4\times Na_2O+3\times Mn; \quad \text{I:}$$

$$Mn_3O_4\rightarrow 3\times Mn+2\times O_2. \quad \text{III:}$$

According to some embodiments, $M^T$ is Mn; $M^T_nO_m$ is $Mn_3O_4$, $M^A$ is K and reaction schemes I and III are:

$$Mn_3O_4+8\times K\rightarrow 4\times K_2O+3\times Mn; \quad \text{I:}$$

$$Mn_3O_4\rightarrow 3\times Mn+2\times O_2. \quad \text{III:}$$

According to some embodiments, $M^T$ is Mn; $M^T_nO_m$ is $Mn_2O_3$, $M^A$ is Na and reaction schemes I and III are:

$$Mn_2O_3+6\times Na\rightarrow 3\times Na_2O+2\times Mn; \quad \text{I:}$$

$$Mn_2O_3\rightarrow 2\times Mn+1.5\times O_2. \quad \text{III:}$$

According to some embodiments, $M^T$ is Mn; $M^T_nO_m$ is $Mn_2O_3$, $M^A$ is K and reaction schemes I and III are:

$$Mn_2O_3+6\times K\rightarrow 3\times K_2O+2\times Mn; \quad \text{I:}$$

$$Mn_2O_3\rightarrow 2\times Mn+1.5\times O_2. \quad \text{III:}$$

According to some embodiments, $M^T$ is Mn; $M^T_nO_m$ is $MnO_2$, $M^A$ is Na and reaction schemes I and III are:

$$MnO_2+4\times Na\rightarrow 2Na_2O+Mn; \quad \text{I:}$$

$$MnO_2\rightarrow Mn+O_2. \quad \text{III:}$$

According to some embodiments, $M^T$ is Mn; $M^T_nO_m$ is $MnO_2$, $M^A$ is K and reaction schemes I and III are:

$$MnO_2+4\times K\rightarrow 2K_2O+Mn; \quad \text{I:}$$

$$MnO_2\rightarrow Mn+O_2. \quad \text{III:}$$

According to some embodiments, $M^T$ is Mn; $M^T_nO_m$ is $Mn_2O_7$, $M^A$ is Na and reaction schemes I and III are:

$$Mn_2O_7+14\times Na\rightarrow 7\times Na_2O+2\times Mn; \quad \text{I:}$$

$$Mn_2O_7\rightarrow 2\times Mn+3.5\times O_2. \quad \text{III:}$$

According to some embodiments, $M^T$ is Mn; $M^T_nO_m$ is $Mn_2O_7$, $M^A$ is K and reaction schemes I and III are:

$$Mn_2O_7+14\times K\rightarrow 7\times K_2O+2\times Mn; \quad \text{I:}$$

$$Mn_2O_7\rightarrow 2\times Mn+3.5\times O_2. \quad \text{III:}$$

According to some embodiments, $M^T$ is Sc; $M^T_nO_m$ is $Sc_2O_3$, $M^A$ is Na and reaction schemes I and III are:

$$Sc_2O_3+6\times Na\rightarrow 3\times Na_2O+2\times Sc; \quad \text{I:}$$

$$Sc_2O_3\rightarrow 2\times Sc+1.5\times O_2. \quad \text{III:}$$

According to some embodiments, $M^T$ is Sc; $M^T_nO_m$ is $Sc_2O_3$, $M^A$ is K and reaction schemes I and III are:

$$Sc_2O_3+6\times K\rightarrow 3\times K_2O+2\times Sc; \quad \text{I:}$$

$$Sc_2O_3\rightarrow 2\times Sc+1.5\times O_2. \quad \text{III:}$$

According to some embodiments, $M^T$ is Ti; $M^T_nO_m$ is $TiO_2$, $M^A$ is Na and reaction schemes I and III are:

$$TiO_2+4\times Na\rightarrow 2Na_2O+Ti; \quad \text{I:}$$

$$TiO_2\rightarrow Ti+O_2. \quad \text{III:}$$

According to some embodiments, $M^T$ is Ti; $M^T_nO_m$ is $TiO_2$, $M^A$ is K and reaction schemes I and III are:

$$TiO_2+4\times K\rightarrow 2K_2O+Ti; \quad \text{I:}$$

$$TiO_2\rightarrow Ti+O_2. \quad \text{III:}$$

This transformation is illustrated in FIG. 9.

According to some embodiments, $M^T$ is Ti; $M^T_nO_m$ is $Ti_2O_3$, $M^A$ is Na and reaction Schemes I and III are:

$$Ti_2O_3+6\times Na\rightarrow 3\times Na_2O+2\times Ti; \quad \text{I:}$$

$$Ti_2O_3\rightarrow 2\times Ti+1.5\times O_2. \quad \text{III:}$$

According to some embodiments, $M^T$ is Ti; $M^T_nO_m$ is $Ti_2O_3$, $M^A$ is K and reaction Schemes I and III are:

$$Ti_2O_3+6\times K\rightarrow 3\times K_2O+2\times Ti; \quad \text{I:}$$

$$Ti_2O_3\rightarrow 2\times Ti+1.5\times O_2. \quad \text{III:}$$

According to some embodiments, $M^T$ is V; $M^T_nO_m$ is VO, $M^A$ is Na and reaction schemes I and III are:

$$VO+2\times Na\rightarrow Na_2O+V; \quad \text{I:}$$

$$VO\rightarrow V+0.5\times O_2. \quad \text{III:}$$

According to some embodiments, $M^T$ is V; $M^T_nO_m$ is VO, $M^A$ is K and reaction schemes I and III are:

$$VO+2\times K\rightarrow K_2O+V; \quad \text{I:}$$

$$VO\rightarrow V+0.5\times O_2. \quad \text{III:}$$

According to some embodiments, $M^T$ is V; $M^T_nO_m$ is $V_2O_3$, $M^A$ is Na and reaction Schemes I and III are:

$$V_2O_3+6\times Na\rightarrow 3\times Na_2O+2\times V; \quad \text{I:}$$

$$V_2O_3\rightarrow 2\times V+1.5\times O_2. \quad \text{III:}$$

According to some embodiments, $M^T$ is V; $M^T_nO_m$ is $V_2O_3$, $M^A$ is K and reaction Schemes I and III are:

$$V_2O_3+6\times K\rightarrow 3\times K_2O+2\times V; \quad \text{I:}$$

$$V_2O_3\rightarrow 2\times V+1.5\times O_2. \quad \text{III:}$$

According to some embodiments, $M^T$ is V; $M^T_nO_m$ is $VO_2$, $M^A$ is Na and reaction schemes I and III are:

$$VO_2+4\times Na\rightarrow 2Na_2O+V; \quad \text{I:}$$

$$VO_2\rightarrow V+O_2. \quad \text{III:}$$

According to some embodiments, $M^T$ is V; $M^T_nO_m$ is $VO_2$, $M^A$ is K and reaction schemes I and III are:

$$VO_2+4\times K\rightarrow 2K_2O+V; \quad \text{I:}$$

$$VO_2\rightarrow V+O_2. \quad \text{III:}$$

According to some embodiments, $M^T$ is V; $M^T_nO_m$ is $V_2O_5$, $M^A$ is Na and reaction Schemes I and III are:

$$V_2O_5+10\times Na\rightarrow 5\times Na_2O+2\times V; \quad \text{I:}$$

$$V_2O_5\rightarrow 2\times V+2.5\times O_2. \quad \text{III:}$$

According to some embodiments, $M^T$ is V; $M^T_nO_m$ is $V_2O_5$, $M^A$ is K and reaction Schemes I and III are:

$$V_2O_5+10\times K\rightarrow 5\times K_2O+2\times V; \quad \text{I:}$$

$$V_2O_5\rightarrow 2\times V+2.5\times O_2. \quad \text{III:}$$

According to some embodiments, $M^T$ is Co; $M^T_nO_m$ is $Co_2O_3$, $M^A$ is Na and reaction schemes I and III are:

$$Co_2O_3+6\times Na\rightarrow 3\times Na_2O+2\times Co; \quad \text{I:}$$

$$Co_2O_3\rightarrow 2\times Co+1.5\times O_2. \quad \text{III:}$$

According to some embodiments, $M^T$ is Co; $M^T_nO_m$ is $Co_2O_3$, $M^A$ is K and reaction schemes I and III are:

$$Co_2O_3+6\times K\rightarrow 3\times K_2O+2\times Co; \quad \text{I:}$$

$$Co_2O_3\rightarrow 2\times Co+1.5\times O_2. \quad \text{III:}$$

According to some embodiments, $M^T$ is Co; $M^T_nO_m$ is CoO, $M^A$ is Na and reaction schemes I and III are:

$$CoO+2\times Na\rightarrow Na_2O+Co; \quad \text{I:}$$

$$CoO\rightarrow Co+0.5\times O_2. \quad \text{III:}$$

According to some embodiments, $M^T$ is Co; $M^T_nO_m$ is CoO, $M^A$ is K and reaction schemes I and III are:

$$CoO+2\times K\rightarrow K_2O+Co; \quad \text{I:}$$

$$CoO\rightarrow Co+0.5\times O_2. \quad \text{III:}$$

According to some embodiments, $M^T$ is Co; $M^T_nO_m$ is $Co_3O_4$, $M^A$ is Na and reaction schemes I and III are:

$$Co_3O_4+8\times Na\rightarrow 4\times Na_2O+3\times Co; \quad \text{I:}$$

$$Co_3O_4\rightarrow 3\times Co+2\times O_2. \quad \text{III:}$$

According to some embodiments, $M^T$ is Co; $M^T_nO_m$ is $Co_3O_4$, $M^A$ is K and reaction schemes I and III are:

$$Co_3O_4+8\times K\rightarrow 4\times K_2O+3\times Co; \quad \text{I:}$$

$$Co_3O_4\rightarrow 3\times Co+2\times O_2. \quad \text{III:}$$

Specific reference is now made to embodiments of the present process, which are directed to the formation of a transition metal alloy.

According to some embodiments, the process is for the preparation of a metal alloy, wherein step (a) or step (b) further comprises providing a second metal, $M^b$ into the reactor, wherein the second metal is alloyable with $M^T$; step (b) comprises combining the second metal with the alkali metal and the transition metal oxide to induce the two reaction sequence of reaction schemes I and II, and further induce the reaction of scheme IV:

$$M^T+M^b\rightarrow M^T\cdot M^b. \quad \text{IV:}$$

According to some embodiments, the second metal, $M^b$, is not an alkali metal. According to some embodiments, the second metal, $M^b$, is a transition metal, $M^{Tb}$.

The term "alloyable" refers to the capability of two metal elements to form an alloy. Thus, the term "alloyable metal", as used herein refers to any metal, which is capable of forming an alloy with the transition metal formed in the process of the present invention. According to some embodiments, the alloyable metal forms an alloy with the transition metal formed in the conditions of process of the present invention (i.e., the conditions of step (b).

Also, the alloyable metal may be provided as a metal oxide and be reduced under the present process reaction conditions (i.e., reduced by the alkali metal), according to some embodiments.

According to some embodiments, the process is for the preparation of a metal alloy, wherein step (a) comprises further providing a second metal oxide having the formula $M^b_iO_j$, wherein each one of i and j is 1, 2, 3, 4, 5, 6 or 7; and step (b) comprises combining the two metal oxides with the alkali metal, wherein reaction schemes I and III are:

$$M^T_nO_m+2m\times M^A\rightarrow m\times M^A{}_2O+n\times M^T; \quad \text{Ia:}$$

$$M^b_iO_j+2j\times M^A\rightarrow j\times M^A{}_2O+i\times M^b; \quad \text{Ib:}$$

$$M^T_nO_m\rightarrow n\times M^T+0.5m\times O_2; \quad \text{IIIa:}$$

$$\text{III}b\text{: } M^b_iO_j\rightarrow i\times M^b+0.5j\times O_2; \quad \text{IIIb:}$$

and wherein step (b) further induced reaction IV of forming the alloy:

$$M^T+M^b\rightarrow M^T\cdot M^b. \quad \text{IV:}$$

It is to be understood that reaction Scheme I is spitted into Ia and Ib, while reaction Scheme III is spitted into IIIa and IIIb.

According to some embodiments, the second metal, $M^b$, is a transition metal, $M^{Tb}$.

Thus, according to some embodiments, step (a) comprises providing at least two transition metal oxides having the formulas $M^{Ta}{}_nO_m$ and $M^{Tb}{}_iO_j$, wherein each one of i and j is 1, 2, 3, 4, 5, 6 or 7, wherein each one of $M^{Ta}$, $M^{Tb}$ is a transition metal selected from the group consisting of: Sc, Ti, V, Cr, Mn, Fe, Co, Ni, Cu and Zn; and step (b) comprises combining the transition metal oxides with the alkali metal, wherein reaction schemes I and III are:

$$M^{Ta}{}_nO_m+2m\times M^A\rightarrow m\times M^A{}_2O+n\times M^Ta; \quad \text{Ia:}$$

$$M^{Tb}{}_iO_j+2j\times M^A\rightarrow j\times M^A{}_2O+i\times M^{Tb}; \quad \text{Ib:}$$

$$M^{Ta}{}_nO_m\rightarrow n\times M^{Ta}+0.5m\times O_2; \quad \text{IIIa:}$$

$$M^{Tb}{}_iO_j\rightarrow i\times M^{Tb}+0.5j\times O_2; \quad \text{IIIb:}$$

and wherein step (b) further induced reaction IV of forming the alloy:

$$M^{Ta}+M^{Tb}\rightarrow M^{Ta}\cdot M^{Tb}. \quad \text{IV:}$$

According to some embodiments, the transition metal alloy formed by any one of the processes of the present invention is selected from the group consisting of: Brass (CuZn), Constantan (CuNi), Cunife (CuNiFe or CuNiFeCo), Cupronickel (CuNiFe or CuNiMn), Manganin (CuMnNi), Maillechort (CuNi or CuNiZn), Elinvar (NiFeCr), Fernico (FeNiCo), Ferromanganese (FeMn), Ferronickel (FeNi), Ferrotitanium (FeTi), Ferrovanadium (FeV), Invar (FeNi), Kovar (FeNiCo), Chromel (NiCr) and Nitinol (NiTi).

Figure 10:
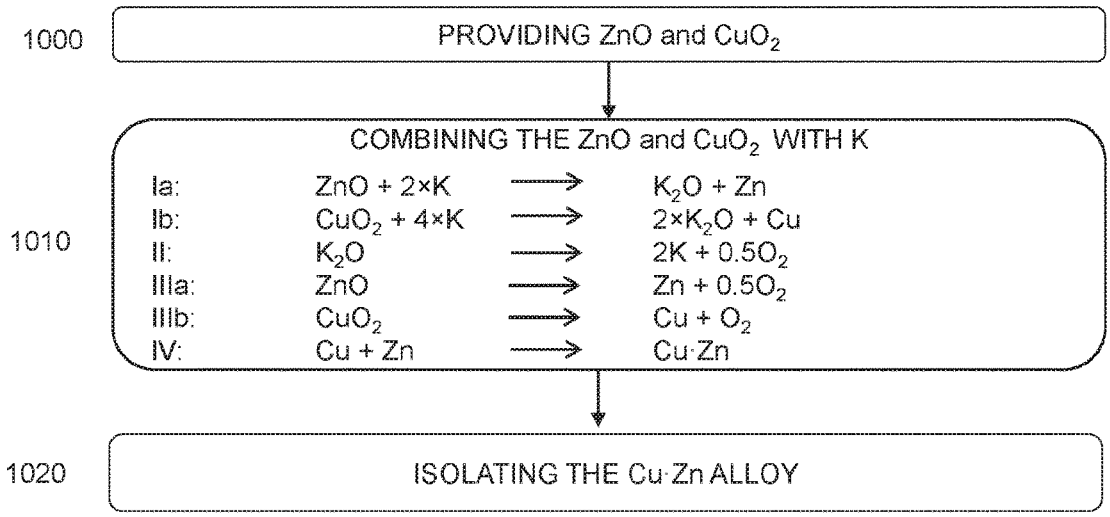
FIG. 10 is a block diagram representing a process for the simultaneous reduction of ZnO into zinc metal and $CuO_2$ into copper metal, and the formation of Cu—Zn alloy therefrom, according to some embodiments.
Figure 11:
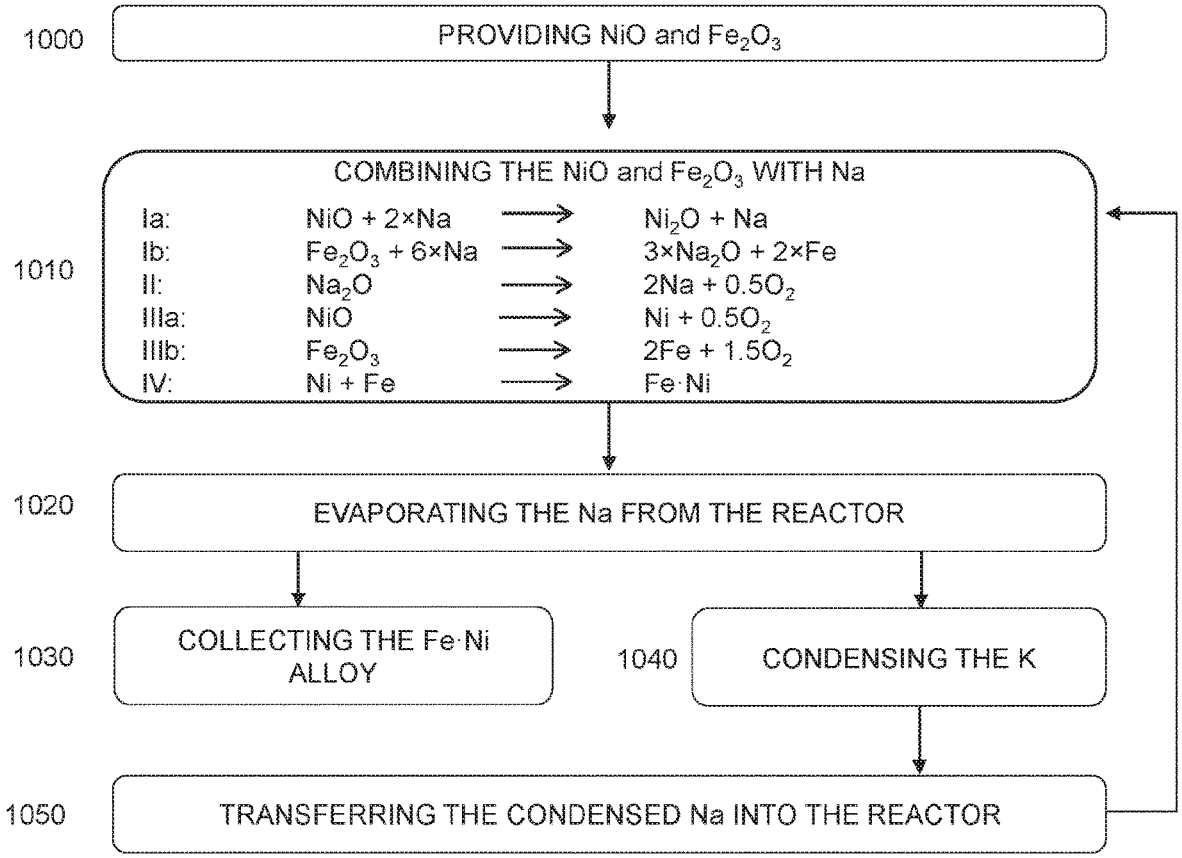
FIG. 11 is a block diagram representing a process for the simultaneous reduction of NiO into nickel metal and $Fe_2O_3$ into iron metal, and the formation of Fe—Ni alloy therefrom, according to some embodiments.

FIGS. 10-11, are block diagrams, each representing a process for the reduction of two transition metal oxide into the corresponding transition metal alloy thereof (CuZn alloy in FIG. 10 and FeNi alloy in FIG. 11).

Reference is now made to a reaction system, configured to carry out the process of the present invention, according to some embodiments.

According to some embodiments, the present process further comprises providing a transition metal oxide reduction system comprising:

- a reactor, which comprises:
  - a housing defining a reaction chamber, and
  - a transition metal oxide inlet, an alkali metal inlet, an alkali metal outlet and an isolated transition metal or alloy outlet, where each of said inlets and outlets is in fluid communication with the reaction chamber;
- an alkali metal container comprising an alkali metal inlet and an alkali metal outlet;
- an isolated transition metal or alloy container comprising a transition metal inlet;
- a condenser, configured to condense the evaporated alkali metal, the condenser comprising a proximal end connected to the alkali metal outlet of the reactor, and a distal end connected to the alkali metal inlet of the alkali metal container;
- an alkali metal transfer pipe comprising a proximal end connected to the alkali metal inlet of the reactor, and a distal end connected to the alkali metal outlet of the alkali metal container;
- a transition metal transfer pipe comprising a proximal end connected to the transition metal outlet of the reactor, a distal end connected to the transition metal inlet of the isolated transition metal or alloy container.

According to some embodiments, the reactor further comprises an inert gas inlet and a gas outlet, where each is in fluid communication with the reaction chamber, and the inert gas inlet is in fluid communication with an inert gas source. According to some embodiments, the inert gas inlet is connected inert gas source through a gas pipe. According to some embodiments, the gas pipe has a valve, configured to regulate the inert gas flow from the inert gas source to the reaction chamber.

According to some embodiments, the present process comprises:

(a) providing the at least one transition metal oxide into the reaction chamber through the transition metal oxide inlet;

(b) combining the transition metal oxide with an alkali metal within the reaction chamber, to induce the two-reaction sequence;

(c) evaporating the alkali metal through the alkali metal outlet of the reactor to isolate the transition metal or alloy thereof in the reaction chamber;

(d) transferring the isolated transition metal or alloy thereof into the isolated transition metal or alloy container through the transition metal transfer pipe;

(e) condensing the evaporated alkali metal using the condenser into the alkali metal container; and (f) transferring the condensed alkali metal from the alkali metal container into the reactor through the alkali metal transfer pipe;

wherein step (e) may precede step (d).

According to some embodiments, step (b) further comprises inserting inert gas into the reaction chamber through the inert gas inlet, thereby maintaining a reaction environment protected from air.

According to some embodiments, step (b), step (c) or both further comprises evacuating the formed oxygen gas through the gas outlet of the reactor.

According to some embodiments, the condenser further comprises a unidirectional valve, positioned between its proximal and distal end, wherein the valve is configured to regulate the flow of evaporated alkali metal from the rector to the alkali metal container. According to some embodiments, the step (f) further comprises regulating the flow of condensed alkali metal from the alkali metal container to the rector using the valve.

According to some embodiments, the transition metal transfer pipe further comprises a unidirectional valve, positioned between its proximal and distal end, wherein the valve is configured to regulate the flow of isolated transition metal or metal alloy from the rector to the isolated transition metal or alloy container. According to some embodiments, step (c) or step (d) further comprises regulating the flow of isolated transition metal or metal alloy from the rector to the isolated transition metal or alloy container using the valve.

EXAMPLES

General Procedure—System

Reaction between several metal oxide with pure sodium at 900° C., for the reduction of the metal oxide to pure metal. The following metal oxides were tested: $Cu_2O$, NiO, $Cr_2O_3$ and $Fe_2O_3$.

System Components:

1. Reactor—SS304 265 mL custom made.
2. SiC crucible 37 mL.
3. First induction heating system (Chinese 6 kw]), Induction coil (5 turns).

4. Second induction system (Chinese 3 kw), Induction coil (3 turns).
5. The system was cooled with one water chiller.
6. SS304 tube 430 mL (sodium disposal reactor) and flange (NW50).
7. Parker connectors for argon insert.
8. Thermocouple type K (3—one outside ½" connection, one in reactor, one in crucible).
9. Argon flow controller company "AALBORG".
10. Three on\off valves 1\4" and one vacuum valve.
11. Bellow trap with ss wool to protect the vacuum pump.
12. Vacuum pump.
13. Stands.
14. Thermal insulating wool.

The material structure of the reaction reactor is SS304 with a volume of 265 mL was connected through a ½" SS316 tube to the sodium disposal reactor with material structure of SS304 with volume of 430 mL with crucible made of SiC was placed inside the reaction reactor.

To protect the induction systems and the Viton o'ring in the KF flange a protection of alumina block used in critical location.

General Experimental Procedure

In the reaction reactor placed crucible with 3 gr of metal oxide and 3 gr of pure sodium, one thermocouple placed inside the reactor to control the first induction system, second thermocouple place inside the crucible to measure the reaction was connect to data logger.

The first induction system heats the lower part of the reaction reactor where the crucible was placed, to 900° C., with heating rate of 15° C. min and argon flow of 40 mL/min during the experiments.

At the start of the reaction the vacuum valve and a second argon outlet valve are closed and the argon flow outlet is through a first argon outlet valve. When the temperature reached to 700° C., the first argon outlet valve was closed and the second valve was opened. Furthermore, when the first induction system reached 700° C., the second induction system was turned on to reach up 200° C. After 70 minutes from the beginning of the reaction, vacuum was initiated using the pump slowly until reaching vacuum for 30 min at 900° C. After 30-minutes, argon was inserted at a flow of 40 mL/min. When the pressure in the system reached to 14.6 psi, the first argon outlet opened and the induction systems were closed.

Example 1: Reduction of $Fe_2O_3$ into Fe

The Reduction of $Fe_2O_3$ into iron metal using sodium as the reducing agent was conducted as detailed above in the General Experimental Procedure. The reaction peak was measured at 480° C. to 720° C. Other reaction parameters are summarized in Table 1:

TABLE 1

Reduction of $Fe_2O_3$ into Fe parameters

| | Weight [gram] |
|---|---|
| Crucible SiC 37 mL | 84.66 |
| $Fe_2O_3$ | 3.04 |
| Na | 3.02 |
| Total | 90.7 |
| Total weight after the reaction | 88.08 |
| Fe after the reaction | 2.62 |

Figure 12A:
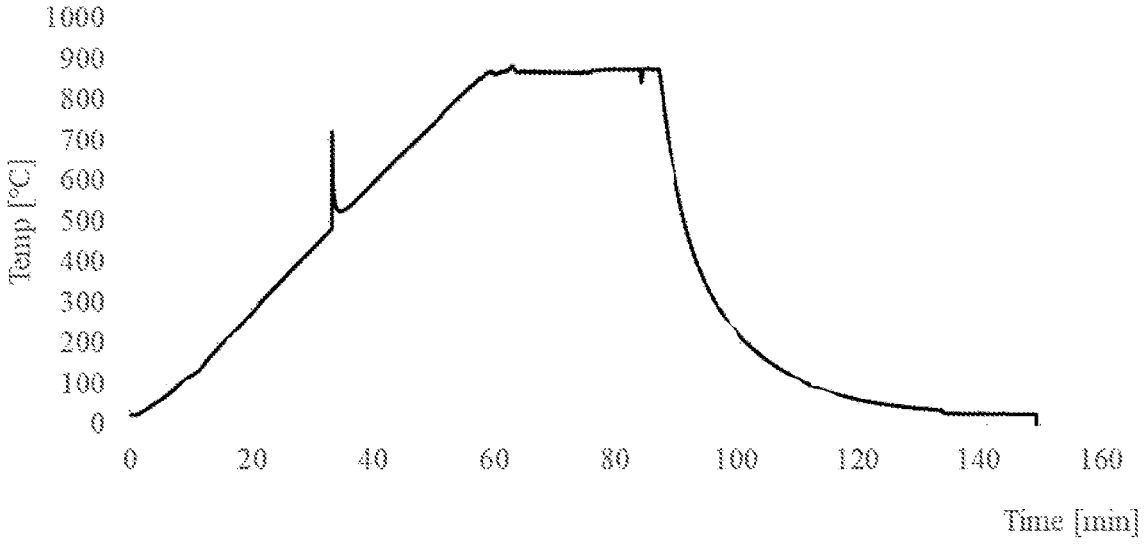
FIGS. 12A and 12B are X-ray diffraction (XRD) patterns of iron produced from two individual reactions between $Fe_2O_3$ and Na, according to some embodiments of the present process.
Figure 12B:
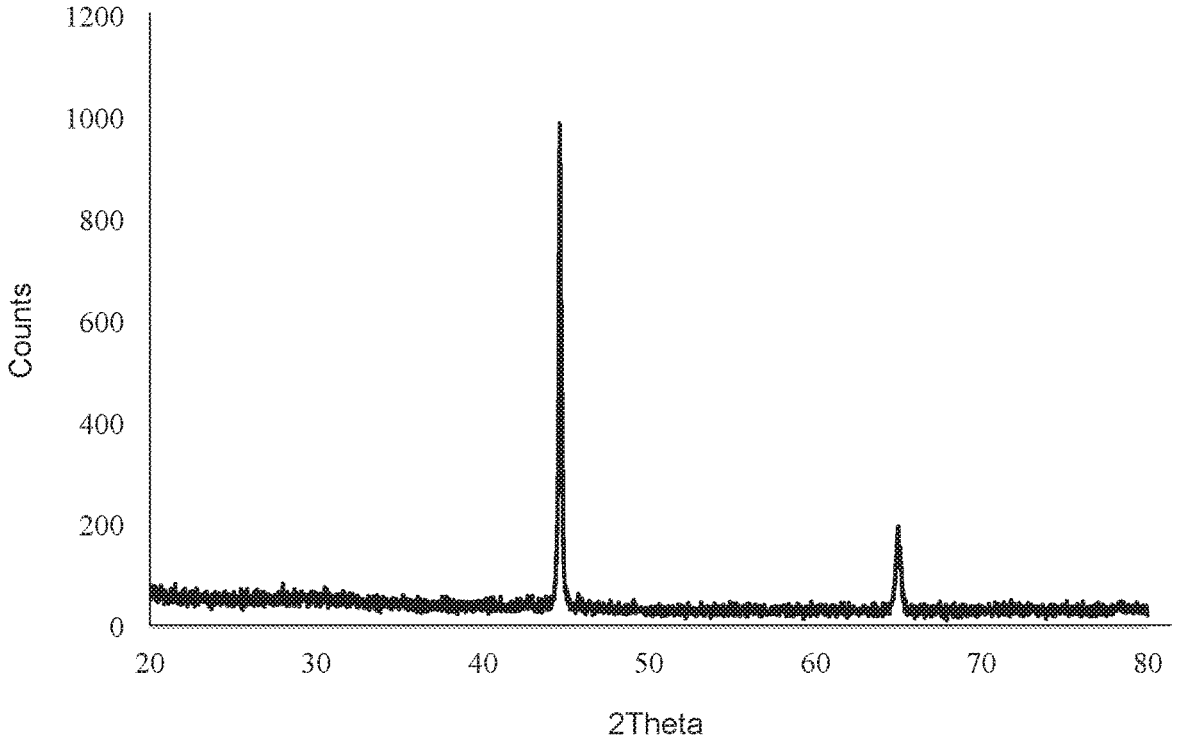

FIG. 12A is a graph depicting the measured temperature (° C.) within the reactor vs. time (min) during the reaction of Example 1. FIG. 12B is and XRD pattern of the reaction products of the reaction of Example 1. Specifically, in Example 1, the main phase is metallic iron.

Example 2: Reduction of $Cu_2O$ into Cu

The Reduction of $Cu_2O$ into copper metal using sodium as the reducing agent was conducted as detailed above in the General Experimental Procedure. The reaction peak was measured at 417° C. to 505° C. at 31.33 minutes from the start of the reaction. Other reaction parameters are summarized in Table 2:

TABLE 2

Reduction of $Cu_2O$ into Cu parameters

| | Weight [gram] |
|---|---|
| Crucible SiC 37 mL | 85.40 |
| $Cu_2O$ | 3 |
| Na | 3 |
| Total | 91.16 |
| Total weight after the reaction | 88.70 |
| Fe after the reaction | 2.4698 (99.33% pure) |

Figure 13A:
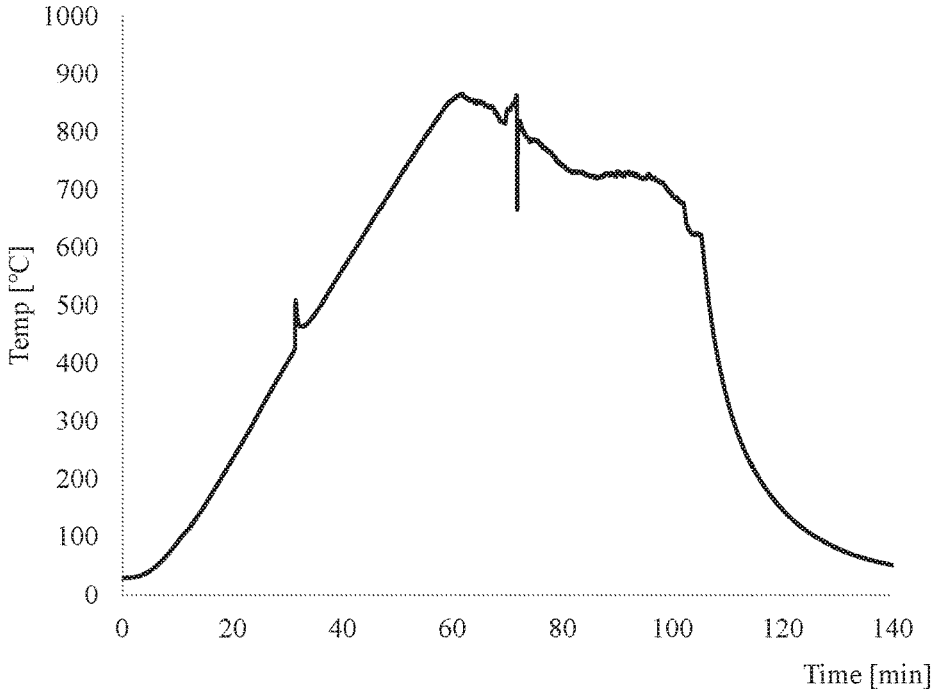
FIG. 13A is a graph depicting the measured temperature (° C.) within the reactor vs. time (min) during the reaction between $Cu_2O$ and Na to form copper metal, according to some embodiments of the present process.
Figure 13B:
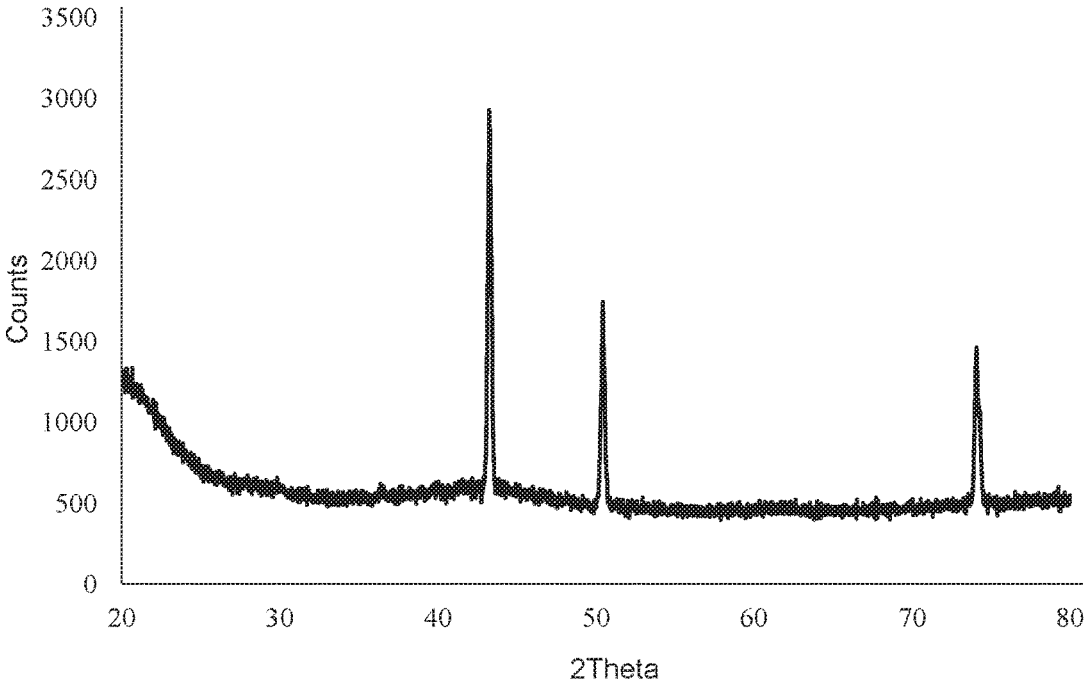
FIG. 13B is an XRD pattern of copper produced a reaction between $Cu_2O$ and Na, according to some embodiments of the present process.

FIG. 13A is a graph depicting the measured temperature (° C.) within the reactor vs. time (min) during the reaction of Example 2. FIG. 13B is and XRD pattern of the reaction products of the reaction of Example 2. Specifically, in Example 2, the main phase is metallic copper with small traces of $Cu_2O$.

Example 3: Reduction of NiO into Ni

The Reduction of NiO into nickel metal using sodium as the reducing agent was conducted as detailed above in the General Experimental Procedure. The reaction peak was measured at 407° C. to 595° C. at 32 minutes from the start of the reaction. Other reaction parameters are summarized in Table 3:

TABLE 3

Reduction of NiO into Ni parameters

| | Weight [gram] |
|---|---|
| Crucible SiC 37 mL | 85.04 |
| NiO | 3.02 |
| Na | 3.04 |
| Total | 91.08 |
| Total weight after the reaction | 89.02 |
| Fe after the reaction | 2.0690(95.4% pure) |

Figure 14A:
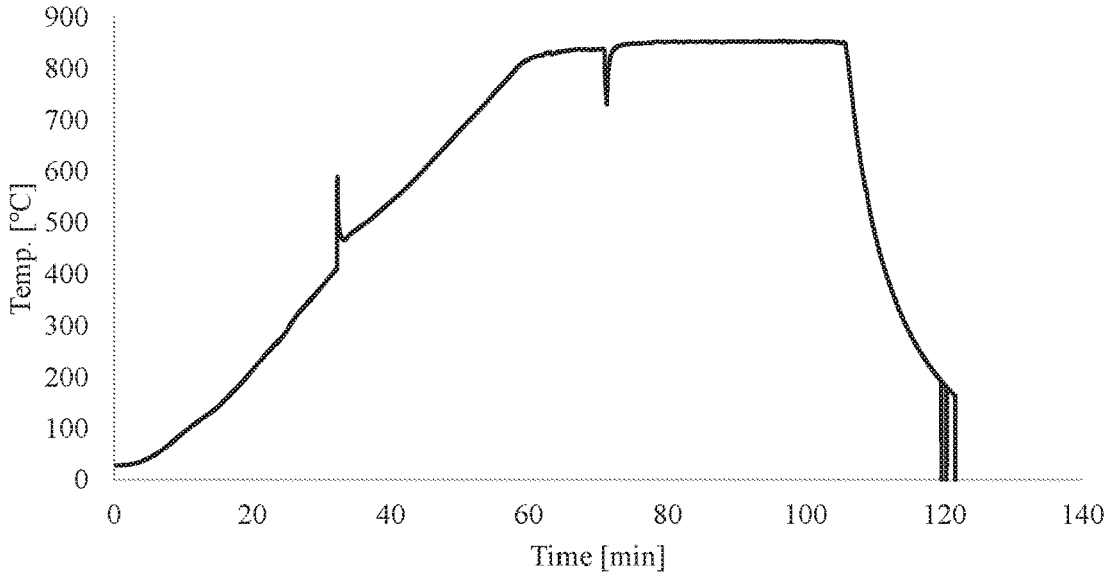
FIG. 14A is a graph depicting the measured temperature (° C.) within the reactor vs. time (min) during the reaction between NiO and Na to form nickel metal, according to some embodiments of the present process.
Figure 14B:
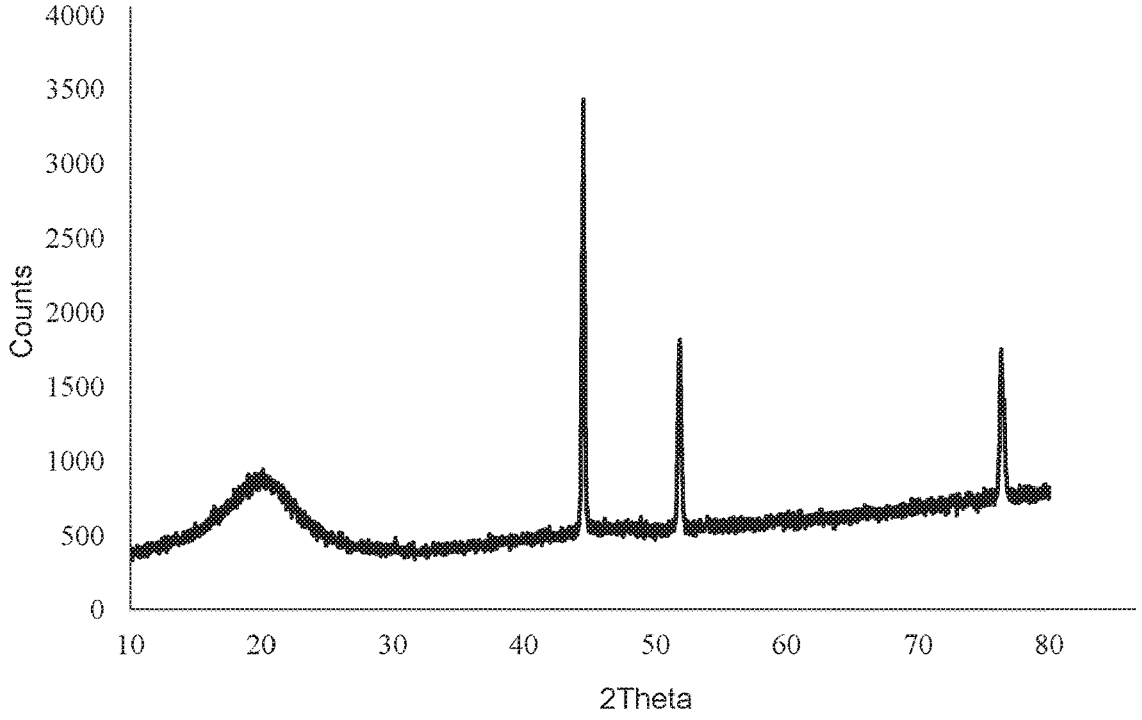
FIG. 14B is an XRD pattern of nickel produced a reaction between NiO and Na, according to some embodiments of the present process.

FIG. 14A is a graph depicting the measured temperature (° C.) within the reactor vs. time (min) during the reaction of Example 3. FIG. 14B is and XRD pattern of the reaction products of the reaction of Example 3. Specifically, the sample measures and shown in FIG. 14B included only metallic nickel.

Example 4: Reduction of $Cr_2O_3$ into Cr

The Reduction of $Cr_2O_3$ into chromium metal using sodium as the reducing agent was conducted as detailed above in the General Experimental Procedure. The reaction peak was measured at 509° C. to 730° C. at 38 minutes from the start of the reaction. Other reaction parameters are summarized in Table 4:

TABLE 4

| Reduction of $Cr_2O_3$ into Cr parameters | |
|---|---|
| | Weight [gram] |
| Crucible SiC 37 mL | 84.68 |
| $Cr_2O_3$ | 3.04 |
| Na | 3.04 |
| Total | 90.74 |
| Total weight after the reaction | 88.62 |
| Fe after the reaction | 3.90 |

Figure 15A:
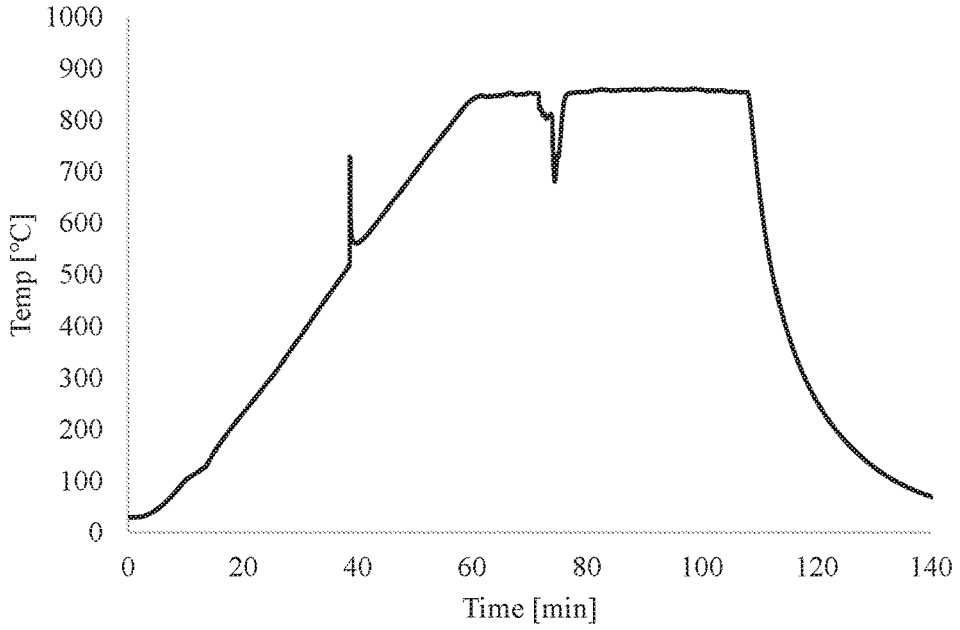
FIG. 15A is a graph depicting the measured temperature (° C.) within the reactor vs. time (min) during the reaction between $Cr_2O_3$ and Na to form chromium metal, according to some embodiments of the present process.
Figure 15B:
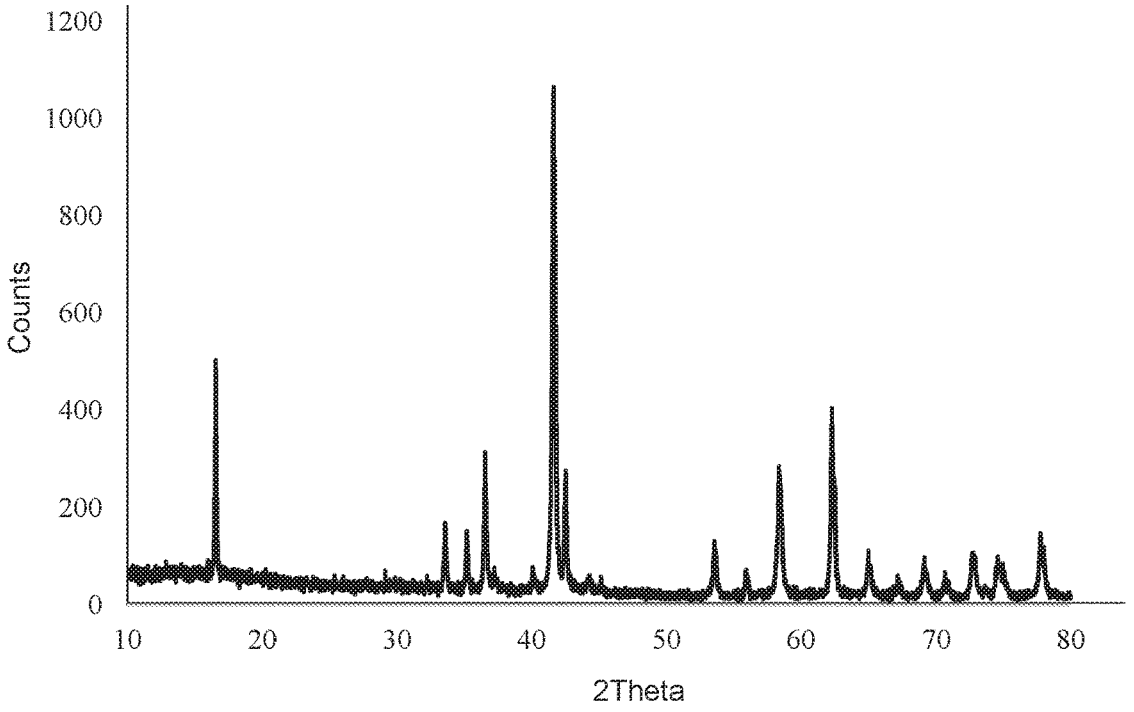
FIG. 15B is an XRD pattern of chromium produced a reaction between $Cr_2O_3$ and Na, according to some embodiments of the present process.

FIG. 15A is a graph depicting the measured temperature (° C.) within the reactor vs. time (min) during the reaction of Example 4. FIG. 15B is and XRD pattern of the reaction products of the reaction of Example 4. Specifically, in this sample there is $NaCrO_2$ (87%) and chromium Nitride Carbide (13%).

CONCLUSIONS

The product from the reaction of nickel and copper oxide with sodium is high quality metal according to the XRD results. In the copper sample the main phase is metallic copper with traces of $Cu_2O$, and in the nickel sample there is only metallic nickel.

Upon application of vacuum of 45 torr with argon flow 40 mL/min at 900° C. for 30 minutes, most of the sodium is disposed out of the reaction mixture. Potassium, which is more volatile, may provide similar, if not improved results.

Although the invention is described in conjunction with specific embodiments thereof, it is evident that numerous alternatives, modifications and variations that are apparent to those skilled in the art may exist. It is to be understood that the invention is not necessarily limited in its application to the details of construction and the arrangement of the components and/or methods set forth herein. Other embodiments may be practiced, and an embodiment may be carried out in various ways. Accordingly, the invention embraces all such alternatives, modifications and variations that fall within the scope of the appended claims.

The invention claimed is:

1. A process for the reduction of a transition metal oxide, the process comprising:

(a) providing at least one transition metal oxide having the formula $M^T{}_nO_m$, wherein each one of n and m is 1, 2, 3, 4, 5, 6 or 7, where $M^T$ is Fe; a first-row transition metal selected from: Sc, Ti, V, Cr, Mn, Fe, Co, Ni, Cu and Zn;

(b) contacting the transition metal oxide with an alkali metal ($M^A$) in a reactor, and adjusting the temperature within the reactor to a temperature T, to induce a two-reaction sequence of the reaction schemes I and II:

$$M^T{}_nO_m+2m+M^A \rightarrow m\times M^A{}_2O+n\times M^T; \quad \text{I:}$$

$$M^A{}_2O \rightarrow 2\times M^A+0.5O_2; \quad \text{II:}$$

so that a net reaction, III, resulting from said two-reaction sequence does not consume the alkali metal, $$M^T{}_nO_m \rightarrow n\times M^T+0.5m\times O_2; \quad \text{III:}$$

and a resulting reaction mixture comprises a reduced transition metal, $M^T$, or alloy thereof, the alkali metal, and optionally oxygen;

wherein $M^A$ is Na or K; and wherein temperature T is above the melting point of the alkali metal and equal or above the decomposition temperature of $M^A{}_2O$; and (c) isolating the reduced transition metal or alloy thereof, from the reaction mixture.

2. The process according to claim 1, wherein step (a) comprises continuously providing the at least one transition metal oxide into the reactor, so that the total transition metal oxide provided in step (a) is in molar excess over the alkali metal of step (b), wherein the molar excess is at least 400%.

3. The process according to claim 1, wherein temperature T is equal or above the boiling point of the alkali metal, wherein the isolation of step (c) entails evaporating the alkali metal from the reactor; and the process further comprises step (d) of collecting the isolated transition metal or alloy thereof.

4. The process according to claim 3, further comprising step (e) of condensing the evaporated alkali metal; and step (f) of transferring the condensed alkali metal into the reactor, thereby recycling the alkali metal.

5. The process according to claim 1, comprising:

(a) providing the at least one transition metal oxide;

(b) combining the transition metal oxide with an alkali metal at a temperature T, to induce the two-reaction sequence;

(c) evaporating the alkali metal from the reactor to produce an isolated transition metal or alloy thereof;

(d) collecting the isolated transition metal or alloy thereof;

(e) condensing the evaporated alkali metal; and (f) transferring the condensed alkali metal into the reactor;

wherein step (e) may precede step (d) and wherein the process further comprises repeating step (a)-(d) for at least one additional sequence.

6. The process according to claim 1, wherein $M^T$ is a first-row transition metal selected from the group consisting of: Fe, Ni, Cr, Cu, Zn and Mn.

7. The process according to claim 1, wherein $M^T$ is Fe; $M^T{}_nO_m$ is $Fe_2O_3$, FeO, $Fe_3O_4$ or a combination thereof; and reaction schemes I and III are:

$$Fe_2O_3+6\times M^A \rightarrow 3\times M^A{}_2O+2\times Fe; \quad \text{I:}$$

$$Fe_2O_3 \rightarrow 2\times Fe+1.5\times O_2; \quad \text{III:}$$

or $$FeO+2\times M^A \rightarrow M^A{}_2O+Fe; \quad \text{I:}$$

$$FeO \rightarrow Fe+0.5\times O_2; \quad \text{III:}$$

or $$Fe_3O_4+8\times M^A \rightarrow 4\times M^A{}_2O+3\times Fe; \quad \text{I:}$$

$$Fe_3O_4 \rightarrow 3\times Fe+2\times O_2. \quad \text{III:}$$

8. The process according to claim 1, for the preparation of a metal alloy, wherein step (a) comprises providing at least two transition metal oxides having the formulas $M^{Ta}{}_nO_m$, and $M^{Tb}{}_iO_j$, wherein each one of i and j is 1, 2, 3, 4, 5, 6 or 7, wherein each one of $M^{Ta}$, $M^{Tb}$ is a transition metal selected from the group consisting of: Sc, Ti, V, Cr, Mn, Fe, Co, Ni, Cu and Zn; and step (b) comprises combining the transition metal oxides with the alkali metal, wherein reaction schemes I and III are:

$$M^{Ta}{}_nO_m+2m\times M^A \rightarrow m\times M^A{}_2O+n\times M^{Ta}; \quad \text{Ia:}$$

$$M^{Tb}{}_iO_j+2j\times M^A \rightarrow j\times M^A{}_2O+i\times M^{Tb}; \quad \text{Ib:}$$

$$M^{Ta}{}_nO_m \rightarrow n\times M^{Ta}+0.5m\times O_2; \quad \text{IIIa:}$$

$$M^{Tb}{}_iO_j \rightarrow i\times M^{Tb}+0.5j\times O_2; \quad \text{IIIb:}$$

and wherein step (b) further induced reaction IV of forming the alloy:

$$M^{Ta}+M^{Tb}\rightarrow M^{Ta}\cdot M^{Tb}. \quad \text{IV:}$$

9. The process according to claim 1, wherein the alkali metal is sodium and scheme II is:

$$Na_2O\rightarrow 2Na+0.5O_2. \quad \text{II:}$$

10. The process according to claim 1, wherein T is at least 540° C.

11. The process according to claim 5, wherein step (c) comprises evaporating the alkali metal and oxygen from the reactor to produce an isolated transition metal or alloy thereof at a purity of at least 90% w/w.

12. The process according to claim 11, wherein the transition metal is Fe and the purity is of at least 99% w/w.

13. The process according to claim 1, wherein the reaction mixture of step (b) is substantially devoid of additional solvents and carriers, and is consisting essentially of the transition metal oxide, the alkali metal and the product reduced transition metal or alloy thereof.

14. The process according to claim 1, wherein the two-reaction sequence of step (b) is conducted in an air and water protected environment.

15. The process according to claim 5, further comprising providing a system comprising:

a reactor, which comprises:

a housing defining a reaction chamber, and a transition metal oxide inlet, an alkali metal inlet, an alkali metal outlet and an isolated transition metal or alloy outlet, where each of said inlets and outlets is in fluid communication with the reaction chamber;

an alkali metal container comprising an alkali metal inlet and an alkali metal outlet;

an isolated transition metal or alloy container comprising a transition metal inlet;

a condenser, configured to condense the evaporated alkali metal, the condenser comprising a proximal end connected to the alkali metal outlet of the reactor, and a distal end connected to the alkali metal inlet of the alkali metal container;

an alkali metal transfer pipe comprising a proximal end connected to the alkali metal inlet of the reactor, and a distal end connected to the alkali metal outlet of the alkali metal container;

a transition metal transfer pipe comprising a proximal end connected to the transition metal outlet of the reactor, a distal end connected to the transition metal inlet of the isolated transition metal or alloy container.

16. The process according to claim 15, wherein the reactor further comprises an inert gas inlet and a gas outlet, where each is in fluid communication with the reaction chamber, and the inert gas inlet is in fluid communication with an inert gas source.

17. The process according to claim 15, comprising:

(a) providing the at least one transition metal oxide into the reaction chamber through the transition metal oxide inlet;

(b) combining the transition metal oxide with an alkali metal within the reaction chamber, to induce the two-reaction sequence;

(c) evaporating the alkali metal through the alkali metal outlet of the reactor to produce an isolated transition metal or alloy thereof;

(d) transferring the isolated transition metal or alloy thereof into the isolated transition metal or alloy container through the transition metal transfer pipe;

(e) condensing the evaporated alkali metal using the condenser into the alkali metal container; and (f) transferring the condensed alkali metal from the alkali metal container into the reactor through the alkali metal transfer pipe;

wherein step (e) may precede step (d).

18. The process according to claim 16, wherein step (b) further comprises inserting inert gas into the reaction chamber through the inert gas inlet, thereby maintaining a reaction environment protected from air.

19. The process according to claim 16, wherein step (b), step (c) or both further comprises evacuating the formed oxygen gas through the gas outlet of the reactor.

20. The process according to claim 16, wherein the condenser further comprises a unidirectional valve, positioned between its proximal and distal end, wherein the valve is configured to regulate the flow of evaporated alkali metal from the reactor to the alkali metal container;

the alkali metal transfer pipe further comprises a unidirectional valve, positioned between its proximal and distal end, wherein the valve is configured to regulate the flow of condensed alkali metal from the alkali metal container to the reactor;

the transition metal transfer pipe further comprises a unidirectional valve, positioned between its proximal and distal end, wherein the valve is configured to regulate the flow of isolated transition metal or metal alloy from the reactor to the isolated transition metal or alloy container.

* * * * *